US005422022A

United States Patent [19]

Chamberlin, III

[11] Patent Number: 5,422,022

[45] Date of Patent: Jun. 6, 1995

[54] LUBRICANTS, LUBRICANT ADDITIVES, AND METHODS FOR LUBRICATING SUMP-LUBRICATED FUEL-INJECTED ALCOHOL-POWERED INTERNAL COMBUSTION ENGINES

[75] Inventor: William B. Chamberlin, III, Kirtland, Ohio

[73] Assignee: The Lubrizol Corporation, Wickliffe, Ohio

[21] Appl. No.: 156,047

[22] Filed: Nov. 23, 1993

Related U.S. Application Data

[63] Continuation of Ser. No. 541,110, Jun. 20, 1990, abandoned.

[51] Int. Cl.[6] ..... C10M 129/26; C10M 135/10

[52] U.S. Cl. ..... 252/32.5; 252/33; 252/33.6; 252/39; 252/51.5 A

[58] Field of Search ..... 252/32.5, 33, 33.6, 252/39, 51.5 A

[56] References Cited

U.S. PATENT DOCUMENTS

| | | | |
|---|---|---|---|
| 3,150,089 | 9/1964 | Hunt | 252/33 |
| 3,219,666 | 11/1965 | Norman et al. | 252/51.5 A |
| 3,272,743 | 9/1966 | Norman et al. | 252/32.5 |
| 3,522,179 | 7/1970 | Le Suer | 252/39 |
| 3,595,790 | 7/1971 | Norman et al. | 252/39 |
| 3,629,109 | 12/1971 | Gergel et al. | 252/39 |
| 3,772,198 | 11/1973 | Cease et al. | 252/32.7 |
| 3,787,374 | 1/1974 | Adams | 260/78.4 |
| 3,804,763 | 4/1974 | Meinhardt | 252/51.5 A |
| 3,948,800 | 4/1976 | Meinhardt | 252/51.5 A |
| 4,113,639 | 9/1978 | Lonstrup et al. | 252/51.5 |
| 4,234,435 | 11/1980 | Meinhardt et al. | 252/46.6 |
| 4,326,972 | 4/1982 | Chamberlin, III | 252/33.3 |
| 4,627,928 | 12/1986 | Karn | 252/33 |
| 4,867,890 | 9/1989 | Colclough et al. | 252/327 |

FOREIGN PATENT DOCUMENTS

| | | |
|---|---|---|
| 1055700 | 6/1979 | Canada . |
| 317354 | 5/1989 | European Pat. Off. . |
| 363046 | 4/1990 | European Pat. Off. . |
| 373454 | 6/1990 | European Pat. Off. . |
| 1306529 | 2/1973 | United Kingdom . |
| 2023169 | 12/1979 | United Kingdom . |
| 8606092 | 10/1986 | WIPO . |
| 8912667 | 12/1989 | WIPO . |

OTHER PUBLICATIONS

Derwent Abstract 88-343022/48 of Japanese Patent J63-256,695A.

P. C. Nautiyal et al., "Wear and Lubrication Characteristics of a Methanol-Fuelled Compression Ignition EngineA Comparison with Pure Diesel and Bifuel Operation", Wear, 135 (1989) 67-78.

*Primary Examiner*—Ellen M. McAvoy

*Attorney, Agent, or Firm*—David M. Shold; Frederick D. Hunter

[57] ABSTRACT

Lubricant compositions are disclosed which comprise (A) at least one neutral or basic metal salt of at least one acidic organic compound, wherein the metal in the salt is magnesium, barium or a mixture thereof, and (B) optionally at least one hydrocarbyl-substituted ashless dispersant in which each hydrocarbyl substituent has a number average molecular weight up to about 1500, provided that the compositions contain no more than 0.06 weight percent calcium, not more than 0.5 weight-percent hydrocarbyl-substituted ashless dispersant in which a hydrocarbyl substituent has a number average molecular weight greater than about 1,500, and optionally not more than 0.5 weight-percent of polymeric viscosity improvers such as olefin copolymer, styrene-diene, and/or polymethacrylate viscosity improvers. Additive concentrate formulations for making such lubricant formulations are also disclosed. Methods for lubricating sump-lubricated fuel-injected alcohol-powered internal combustion engines are described which utilize these lubricant compositions to help prevent the formation of deposits in fuel injectors and provide advantageous rust and corrosion inhibition properties. These formulations can also be useful for lubricating combustion engines powered by petroleum- and coal-derived fuels.

78 Claims, 1 Drawing Sheet

LUBRICANTS, LUBRICANT ADDITIVES, AND METHODS FOR LUBRICATING SUMP-LUBRICATED FUEL-INJECTED ALCOHOL-POWERED INTERNAL COMBUSTION ENGINES

This is a continuation of application Ser. No. 07/541,110 filed on Jun. 20, 1990, now abandoned.

TECHNICAL FIELD

The present invention relates to the field of lubricants, lubricant additives, and methods for lubricating internal combustion engines. In particular, the present invention relates to the field of metal-containing lubricating oil compositions for sump-lubricated fuel-injected internal combustion engines which are suitable for alcohol-powered internal combustion engines.

BACKGROUND OF THE INVENTION

In recent years there is a growing concern about the accumulation in the environment of pollutants emitted from the burning of hydrocarbon fuels. One source of pollutants, the internal combustion engine, is of concern. In particular, the diesel engine is the focus of a high degree of concern due to the high level of particulate matter produced by that type of engine. The U.S. Environmental Protection Agency heavy-duty diesel emission regulations require that by the year 1991 the emission of particulate matter must be reduced from 0.60 grams per (brake-horsepower)-hour (g/bhp-hr) to 0.25 g/bhp-hr for trucks and 0.10 g/bhp-hr for urban buses. Heavy-duty trucks must meet the same standard as the 1991 urban bus standard by the year 1994. Although thorough optimization of internal engine components, the application of new component technology such as electronic control and variable geometry turbocharging, and emission after-treatment (particulate traps, catalysts, etc.) might achieve some reduction in emissions, the development of diesel engines capable of utilizing alternative fuels which do not generate the high level of particulate matter generated by diesel fuel is important in achieving these strict emission standards. Promising alternative fuels include methanol and ethanol.

Internal combustion diesel engines configured to run on methanol have problems with plugging and fouling of the fuel injectors and fuel pumps. It has been discovered that plugging and fouling are often caused by deposits found near any fuel-lubricant interface, such as within the body of the fuel injector and in the fuel pressuring pump, if one exists, and also at the fuel injector tip. Those deposits have a significant deleterious effect upon the performance and fuel efficiency of fuel-modified internal combustion engines due to interference with the flow of fuel to the fuel injector tip and distortions in the spray pattern of the fuel emitted from the tip of the fuel injector into the combustion chamber.

At the same time, an engine run on alcohol fuel requires effective rust and corrosion inhibition, since alcohol fuels generate more water, formic acid and formaldehyde than diesel fuel, a combination which is highly corrosive to most metallic engine parts. Corrosion often occurs in combustion chambers, particularly on piston heads, and can also occur on the crankshaft, bearings, and other mechanical components which directly or indirectly come into contact with the fuel or its combustion products. Attempts to avoid the fuel injector fouling problem by reducing the concentration of lubricant additive in the lubricant formulation reduce the level of components which provide the critical rust and corrosion inhibition required by alcohol-powered internal combustion engines.

Reducing the quantity of lubricant additives also prevents formulations from qualifying for use in diesel or gasoline fueled engines, making it necessary to stock a separate formulation for alcohol-powered engines and safeguard against use in the wrong engine.

The present invention is directed to lubricant compositions and concentrates for making them which solve the fuel injector plugging and fouling problem and, at the same time, provide effective rust and corrosion inhibition. These lubricant compositions generally comprise at least one neutral or basic salt of at least one acidic organic compound wherein the metal in said salt is magnesium or barium, or a mixture thereof, and, optionally, at least one hydrocarbyl-substituted ashless dispersant wherein each hydrocarbyl substituent has a number average molecular weight up to about 1500, provided that the amounts of calcium, hydrocarbyl-substituted ashless dispersant in which a hydrocarbyl substituent has a number average molecular weight greater than about 1500, and optionally polymeric viscosity improvers are below certain limits further described below. These lubricants can be formulated to qualify for use in more conventional diesel- and gasoline-powered engines.

The book "Lubricant Additives" by M. W. Ranney, published by Noyes Data Corporation of Parkridge, N.J. (1973), discloses a number of metal salts of various sulfonic and carboxylic acids and of phenols which are useful as detergent/ dispersants in lubricating oil products. The book also entitled "Lubricant Additives" by C. V. Smallheer and R. K. Smith, published by the Lezius-Hiles Co. of Cleveland, Ohio (1967), similarly discloses a number of detergent/ dispersants including sulfonates, phenates and carboxylates which are useful as dispersants.

Novel methods for lubricating sump-lubricated fuel-injected alcohol-powered internal combustion engines which solve the fuel injector plugging and fouling problems and/or provide effective rust and/or corrosion inhibition are also included within the scope of the present invention.

SUMMARY OF THE INVENTION

The present invention is directed to lubricant formulations which comprise:

(A) at least one neutral or basic metal salt of at least one acidic organic compound, wherein the metal in the salt is magnesium, barium or a mixture thereof;

(B) optionally at least one hydrocarbyl-substituted ashless dispersant wherein each hydrocarbyl substituent has a number average molecular weight up to about 1,500; and (C) at least one oil of lubricating viscosity; provided that the composition contains not more than about 0.06 weight-percent calcium, not more than about 0.5 weight-percent hydrocarbyl-substituted ashless dispersant in which a hydrocarbyl substituent has a number average molecular weight greater than about 1500, optionally not more than about 0.5 weight-percent of polymeric viscosity improvers, optionally not more than 0.06 weight-percent sodium, and optionally not more than about 1.5 weight-percent total acylated amine dispersants.

Another aspect of the present invention is methods for lubricating conventional (i.e., gasoline or diesel) fueled and/or alcohol-powered internal combustion engines utilizing the lubricant formulations of the present invention. The inventor has found that when the lubricant formulations of the present invention are utilized for lubricating a sump-lubricated, fuel-injected internal combustion engine, they prevent or reduce efficiency-reducing deposits in alcohol-powered engine fuel injection systems while reducing the rate at which rust- and corrosion-prone metal engine parts are attacked by alcohol fuel-type contaminants, and function as "universal" engine lubricants when a dispersant amount of component (B) is present.

In one embodiment, the method of the present invention is a method for lubricating sump-lubricated fuel-injected alcohol-powered internal combustion engines comprising circulating within an alcohol-powered engine a composition comprising (A) at least one neutral or basic metal salt of at least one acidic organic compound, wherein the metal in the salt is magnesium, barium or a mixture thereof; and (C) at least one oil of lubricating viscosity, provided that the composition contains not more than about 0.06 weight-percent calcium, not more than about 0.5 weight-percent hydrocarbyl-substituted ashless dispersant in which a hydrocarbyl substituent has a molecular weight greater than about 1500.

DESCRIPTION OF THE PREFERRED EMBODIMENTS

Figure 1:
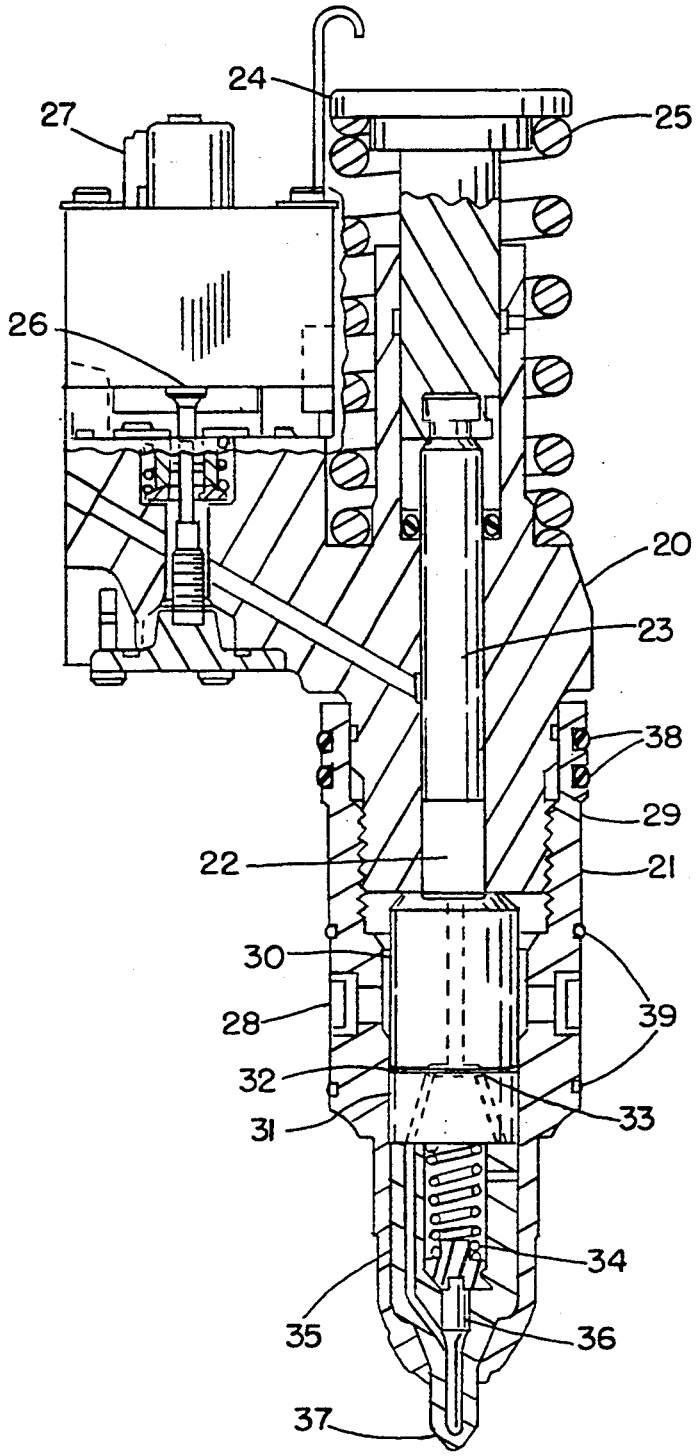
FIG. 1 shows a diagram of cross-sectional view of one type of electronic fuel injector unit typically used in diesel engines.

As used in this specification and in the appended claims, the term "hydrocarbyl" denotes a group having a carbon atom directly attached to the remainder of the molecule and having a hydrocarbon or predominantly hydrocarbon character within the context of this invention. Such groups include the following:

(1) Hydrocarbon groups; that is, aliphatic, (e.g., alkyl or alkenyl), alicyclic (e.g., cycloalkyl or cycloalkenyl), aromatic, aliphatic- and alicyclic-substituted aromatic, aromatic-substituted aliphatic and alicyclic groups, and the like, as well as cyclic groups wherein the ring is completed through another portion of the molecule (that is, any two indicated substituents may together form an alicyclic group). Such groups are known to those skilled in the art. Examples include methyl, ethyl, octyl, decyl, octadecyl, cyclohexyl, phenyl, etc.

(2) Substituted hydrocarbon groups; that is, groups containing non-hydrocarbon substituents which, in the context of this invention, do not alter the predominantly hydrocarbon character of the group. Those skilled in the art will be aware of suitable substituents. Examples include halo, hydroxy, nitro, cyano, alkoxy, acyl, etc.

(3) Hetero groups; that is, groups which, while predominantly hydrocarbon in character within the context of this invention, contain atoms other than carbon in a chain or ring otherwise composed of carbon atoms. Suitable hetero atoms will be apparent to those skilled in the art and include, for example, nitrogen, oxygen and sulfur.

In general, no more than about three substituents or hetero atoms, and preferably no more than one, will be present for each 10 carbon atoms in the hydrocarbyl group.

Terms such as "alkyl-based", "aryl-based", and the like have meanings analogous to the above with respect to alkyl groups, aryl groups and the like.

The term "hydrocarbyl-based" has the same meaning and can be used interchangeably with the term hydrocarbyl when referring to molecular groups having a carbon atom attached directly to the remainder of a molecule.

The term "lower" as used herein in conjunction with terms such as hydrocarbyl, alkyl, alkenyl, alkoxy, and the like, is intended to describe such groups which contain a total of up to 7 carbon atoms.

The term "oil-soluble" refers to a material that is soluble in mineral oil to the extent of at least about one gram per liter at 25° C.

The term "conventional fuel" or "conventional internal combustion engine fuel" as used herein refers to hydrocarbon fuel for use in internal combustion engines other than an alcohol, typically obtained from petroleum, coal, or other hydrocarbonaceous source, such as diesel oil and gasoline.

The term "sump-lubricated" refers to engines which circulate lubricant in a system which is separate from the fuel system, as opposed to engines which depend on lubrication by lubricant mixed with fuel. Diesel engines and four-cycle gasoline powered engines are generally sump-lubricated, whereas two-cycle gasoline engines generally are not. The term "sump-lubricated" includes engines lubricated by what is known as a "dry sump" in which the lubricant is collected and circulated from the side of the engine rather than from the bottom. A term associated with the lubricant of a sump-lubricated engine is "crankcase lubricant".

The term "polymeric viscosity improver" refers to a polymeric component which, when incorporated in a lubricant composition in operative amounts, allow the formulation to simultaneously meet the SAE (Society of Automotive Engineers) low temperature and high temperature viscosity requirements for multigrade lubricants. The low temperature requirement is presently determined using the cold cranking simulator viscosity (ASTM procedure D2602) and the high temperature requirement is presently based on the kinematic viscosity determined by ASTM procedure D445. ASTM procedures D2602 and D445 are hereby incorporated herein by reference. Typical SAE viscosity specifications that qualify a lubricant as multigrade include 5W-30, 5W-40, 10W-30, 10W-40 and 15W-40. Polymeric viscosity improvers are defined herein as generally having a number average molecular weight of at least about 20,000, and more typically at least about 50,000. Number average molecular weights in excess of 150,000 are common.

(A) Neutral or Basic Metal Salt

Component (A) is a neutral or basic metal salt of a at least one acidic organic compound, the metal in said salt being selected from the group consisting of magnesium, barium, or a mixture of magnesium and barium. Magnesium is the preferred metal of component (A) from the standpoint of environmental safety, since the other metal, barium, is known to be somewhat toxic to humans.

The term "basic" is a term of art which is generic to well known classes of metal salts. These basic metal salts have also been referred to as "overbased", "superbased", "hyperbased", "high-metal containing salts", and the like. Basic metal salts are characterized by a metal content in excess of that which would be present according to the stoichiometry of the metal and the particular acidic organic compound reacted with the metal, e.g., a sulfonic acid. Thus, if a monosulfonic acid,

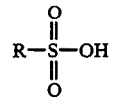

is neutralized with a basic metal compound, e.g., magnesium hydroxide, the "neutral" or "normal" metal salt produced will contain one equivalent of magnesium for each equivalent of acid, i.e.,

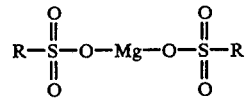

Processes for making such neutral and basic metal salts are well known in the art. Neutral salts can be made by heating a mineral oil solution of an acidic organic compound with a stoichiometric equivalent amount of a metal neutralizing agent such as the metal oxide, hydroxide, carbonate, bicarbonate, or sulfide at a temperature above about 50° C. and filtering the resulting mass. Basic salts are similarly made with the exception that a stoichiometric excess of the metal is used. Also, a "promoter" in the neutralization step to aid the incorporation of the excess metal can be used in making the basic salts. Examples of compounds useful as the promoter include phenolic substances such as phenol, naphthol, alkylphenol, thiophenol, sulfurized alkylphenol, and condensation products of formaldehyde with a phenolic substance; alcohols such as methanol, 2-propanol, octyl alcohol, cellosolve, carbitol, ethylene glycol, stearyl alcohol, and cyclohexyl alcohol; and amines such as aniline, phenylenediamine, phenothiazine, phenyl-betanaphthylamine, and dodecylamine. A particularly effective method for preparing the basic salts comprises mixing the acidic organic compound with an excess of a basic metal neutralizing agent and at least one alcohol promoter, and carbonating the mixture at an elevated temperature such as 60°–200° C.

Another approach for preparing overbased compositions is to add water and metal alkoxide-carbonate complex to an acidic organic compound neutralized with ammonium ions as described, for example, in U.S. Pat. No. 3,772,198. Preparation of metal alkoxide-carbonate complex starting materials for this process is known in the art and described, for example, in U.S. Pat. Nos. 3,150,089 and 3,150,088. U.S. Pat. Nos. 3,150,088, 3,150,089 and 3,772,198 are hereby fully incorporated herein by reference for their disclosure relating to these methods of preparation and the products produced thereby.

The acidic organic compounds from which these metal salts are derived can be one or more carboxylic acids, sulfur-containing acids, phosphorus-containing acids, phenols, or a mixture of two or more thereof. These acidic organic compounds are discussed in greater detail below.

Carboxylic Acids

The carboxylic acids useful in making the salts (A) of the invention may be aliphatic or aromatic, mono-or polycarboxylic acids or acid-producing compounds. Throughout this specification and in the appended claims, any reference to carboxylic acids is intended to include the acid-producing derivatives thereof such as anhydrides, esters, acyl halides, lactones and mixtures thereof unless otherwise specifically stated.

The carboxylic acid may contain polar substituents, provided that the polar substituents are not present in proportions sufficiently large to alter significantly the hydrocarbon character of the carboxylic acid. Typical suitable polar substituents include halo, such as chloro and bromo, oxo, oxy, formyl, sulfenyl, sulfinyl, thio, nitro, etc. Such polar substituents, if present, preferably do not exceed abut 10% by weight of the total weight of the hydrocarbon portion of the carboxylic acid, exclusive of the carboxyl groups.

The mono- and polycarboxylic acids contemplated for use in this invention include saturated and unsaturated acids. Examples of useful monocarboxylic acids include dodecanoic acid, palmitic acid, decanoic acid, oleic acid, stearic acid, myristic acid, linoleic acid, linolenic acid, naphthenic acid, chlorostearic acid, commercially available mixtures of fatty acids, such as tall oil fatty acids, etc. Anhydrides and lower alkyl esters of these acids can also be used. Mixtures of two or more such acids can also be used. An extensive discussion of these acids is found in Kirk-Othmer "Encyclopedia of Chemical Technology" Third Edition, 1978, John Wiley & Sons New York, pp. 814–871, which is incorporated herein by reference.

Additional monocarboxylic acids include substituted aliphatic acids, i.e., acids having one or more lower acyclic pendant hydrocarbyl groups. Such acids often contain a principal chain having from about 14 to about 20 saturated aliphatic carbon atoms and at least one, but usually not more than about four, pendant acyclic hydrocarbyl groups. The principal chain of the acid is exemplified by groups derived from tetradecane, pentadecane, hexadecane, heptadecane, octadecane, and eicosane. The hydrocarbyl group is preferably a lower alkyl group such as methyl, ethyl, n-propyl, isopropyl, n-butyl, isobutyl, tert-butyl, n-hexyl, or other groups having up to about 7 carbon atoms, including all isomers thereof. The hydrocarbyl group may also be a polar-substituted alkyl group such as chloromethyl, bromobutyl, methoxyethyl, or the like, but it preferably contains no more than one polar substituent per group.

Specific examples of such substituted aliphatic acids include 10-methyl-tetradecanoic acid, 11-methyl-pentadecanoic acid, 3-ethyl-hexadecanoic acid, 15-methyl-heptadecanoic acid, 16-methyl-heptadecanoic acid, 6-methyl-octadecanoic acid, 8-methyl-octadecanoic acid, 10-methyl-octadecanoic acid, 14-methyl-octadecanoic acid, 16-methyl-octadecanoic acid, 15-ethyl-heptadecanoic acid, 3-chloromethyl-nonadecanoic acid, 7,8,9,10-tetramethyl-octadecanoic acid, and 2,9,10-trimethyl-octadecanoic acid.

The substituted aliphatic acids include mixtures of branched-chain acids prepared by the isomerization of commercial fatty acids of, for example, about 16 to about 20 carbon atoms. A useful method involves heating the mixture of fatty acids at a temperature above about 250° C. and a pressure between about 200 and 700 psi, distilling the crude isomerized acid, and hydrogenating the distillate to produce a substantially saturated isomerized acid. The isomerization can be promoted by a catalyst such as mineral clay, diatomaceous earth, aluminum chloride, zinc chloride, ferric chloride, or some other Friedel-Crafts catalyst. The concentration of the catalyst may be as low as about 0.01%, but more often from about 0.1% to about 3% by weight of the isomerization mixture. Water also promotes the isomerization and a small amount, from about 0.1% to about 5% by weight, of water may thus be advantageously added to the isomerization mixture. The unsaturated fatty acids from which the substituted aliphatic acids may be derived include oleic acid, linoleic acid, linolenic acid, and commercial fatty acid mixtures such as tall oil acids, etc. Anhydrides of these acids and mixtures of two or more such acids can also be used. A discussion of these acids is found in pages 814–871 of Kirk Othmer, "Encyclopedia of Chemical Technology" Third Edition, 1978, supra.

Examples of lower-molecular weight polycarboxylic acids include dicarboxylic acids and derivatives such as sebacic acid, cetyl malonic acid, tetrapropylene-substituted succinic anhydride, etc.

The generally higher molecular weight hydrocarbyl-substituted mono- and polycarboxylic acids and anhydrides, and ester and amide derivatives thereof, suitable for use in making the salts (A), and processes for making such acids, are well known in the art and have been described in detail, for example, in the following U.S., British and Canadian patents: U.S. Pat. Nos. 3,024,237; 3,087,936; 3,163,603; 3,172,892; 3,215,707; 3,219,666; 3,231,587; 3,245,910; 3,254,025; 3,271,310; 3,272,743; 3,272,746; 3,278,550; 3,288,714; 3,306,907; 3,307,928; 3,312,619; 3,341,542; 3,346,354; 3,367,943; 3,373,111; 3,374,174; 3,381,022; 3,394,179; 3,454,607; 3,346,354; 3,470,098; 3,630,902; 3,652,616; 3,755,169; 3,868,330; 3,912,764; 4,234,435; and 4,368,133; British Patents 944,136; 1,085,903; 1,162,436; and 1,440,219; and Canadian Patent 956,397. These patents are incorporated herein by reference.

As disclosed in the foregoing patents, there are several processes for preparing these hydrocarbyl-substituted carboxylic acids. Generally, these processes involve the reaction of (1) an olefinically unsaturated carboxylic acid, acid halide, anhydride or ester reactant with (2) a chlorinated olefinically unsaturated or chlorinated hydrocarbon containing at least abut 8 aliphatic carbon atoms at a temperature within the range of about 100°–300° C. The chlorinated olefinically unsaturated hydrocarbon reactant preferably contains at least about 10 carbon atoms and may contain polar substituents, oil-solubilizing pendant groups, and be unsaturated within the general limitations explained hereinabove.

When preparing the hydrocarbyl-substituted carboxylic acids, the carboxylic acid reactant usually corresponds to the formula $R_o$—$(COOH)_n$, where $R_o$ is characterized by the presence of at least one olefinically unsaturated carbon-to-carbon covalent bond and n is an integer from 1 to about 6 and preferably 1 or 2. The acidic reactant can also be functional derivatives thereof corresponding to a carboxylic acid halide, anhydride, ester, salt, amide, imide, nitrile and other nitrogen-containing compounds of the aforedescribed acids. Methods of preparing such functional derivatives are well known to those skilled in art and may be prepared according to the methods described in U.S. Pat. No. 4,670,173, which is incorporated herein by reference, particularly as set forth in columns 6 and 7 of that reference. Preferably, the carboxylic acids for use in making the neutral or basic salt (A) of the present invention have a high carboxy group content to provide the desired acidity for reacting a metal neutralizing agent to form the metal salt.

Ordinarily, the total number of carbon atoms in the acidic reactant will not exceed abut 20, preferably this number will not exceed abut 10 and generally will not exceed about 6. Preferably the acidic reactant will have at least one ethylenic linkage in an alpha, beta-position with respect to at least one carboxyl function. Exemplary acidic reactants-are acrylic acid, methacrylic acid, maleic acid, maleic anhydride, fumaric acid, cinnamic acid, 1-phenylpropenoic acid, itaconic acid, itaconic anhydride, citraconic acid, citraconic anhydride, mesaconic acid, glutaconic acid, chloromaleic acid, aconitic acid, crotonic acid, methylcrotonic acid, sorbic acid, 3-hexenoic acid, 10-decenoic acid, and the like. Preferred acid reactants include acrylic acid, methacrylic acid, maleic acid, and maleic anhydride.

The olefinically unsaturated hydrocarbon reactant and the chlorinated hydrocarbon reactant used in the preparation of these hydrocarbyl-substituted carboxylic acids are preferably substantially saturated petroleum fractions, substantially saturated olefin polymers and the corresponding chlorinated products. Polymers and chlorinated polymers derived from mono-olefins having from 2 to about 10 carbon atoms are preferred. Especially useful polymers are the polymers of 1-mono-olefins such as ethylene, propene, 1-butene, 1-hexene, 1-octene, 2-methyl-1-heptene, 3-cyclohexyl-1-butene, and 2-methyl-5-propyl-1-hexene. Polymers of medial olefins, i.e., olefins in which the olefinic linkage is not at the terminal position, likewise are useful. These are exemplified by 2-butene, 3-pentene, and 4-octene.

Interpolymers of the above-illustrated mono-olefins with each other and with other interpolymerizable olefinic substances such as aromatic olefins, cyclic olefins, and polyolefins, are also useful sources of the olefinically unsaturated reactant. Such interpolymers include for example, those prepared by polymerizing isobutene with styrene, isobutene with butadiene, butadiene with styrene, propene with isoprene, propene with isobutene, ethylene with piperylene, isobutene with chloroprene, isobutene with p-methyl-styrene, 1-hexene with 1,3-hexadiene, 1-octene with 1-hexene, 1-heptene with 1-pentene, 3-methyl-1-butene with 1-octene, 3,3-di-methyl-1-pentene with 1-hexene, isobutene with styrene and piperylene, etc.

Preferred interpolymers include block copolymers, such as block polymers derived from vinyl substituted aromatics and conjugated dienes. Examples of such preferred interpolymers and how to make them are described in U.S. Pat. No. 4,670,173, supra.

For reasons of oil solubility and oxidative stability, the interpolymers contemplated for use in preparing the carboxylic acids of this invention are preferably substantially aliphatic and substantially saturated, that is, they should contain at least about 80%, on a weight basis, of units derived from aliphatic mono-olefins. Preferably, they will contain no more than about 5% olefinic linkages based on the total number of the carbon-to-carbon covalent linkages present.

In one embodiment of the invention, the polymers and chlorinated polymers are obtained by the polymerization of a $C_4$ refinery stream having a butene content of about 35% to abut 75% by weight and an isobutene content of about 30% to about 60% by weight in the presence of a Lewis acid catalyst such as aluminum chloride or boron trifluoride. These polyisobutylenes preferably contain predominantly (that is, greater than about 80% of the total repeat units) isobutylene repeat units.

The chlorinated hydrocarbons and olefinically unsaturated hydrocarbons used in the preparation of these carboxylic acids can have number average molecular weights of up to about 1,900 or even higher. However, chlorinated or unsaturated hydrocarbons that have number average molecular weights up to about 1,500 are preferred, and those having number average molecular weights up to about 1,100 are even more preferred. The inventor has found that additives which contain these preferred hydrocarbyl substituents perform better in sump-lubricated fuel-injected alcohol-powered internal combustion engines, causing fewer problems, if any, at the fuel injectors and providing a high level of rust and corrosion inhibition.

The hydrocarbyl-substituted carboxylic acids may also be prepared by halogenating a hydrocarbon such as the above-described olefin polymers to produce a polyhalogenated product, converting the polyhalogenated product to a polynitrile, and then hydrolyzing the polynitrile. They may be prepared by oxidation of a high molecular weight polyhydric alcohol with potassium permanganate, nitric acid, or a similar oxidizing agent. Another method involves the reaction of an olefin or a polar-substituted hydrocarbon such as a chloropolyisobutene with an unsaturated polycarboxylic acid such as 2-pentene-1,3,5-tricarboxylic acid prepared by dehydration of citric acid.

Monocarboxylic acids may be obtained by oxidizing a mono-alcohol with potassium permanganate or by reacting a halogenated high molecular weight olefin polymer with a ketene. Another convenient method for preparing monocarboxylic acid involves the reaction of metallic sodium with an acetoacetic ester or a malonic ester of an alkanol to form a sodium derivative of the ester and the subsequent reaction of the sodium derivative with a halogenated high molecular weight hydrocarbon such as brominated wax or brominated polyisobutene.

Monocarboxylic and polycarboxylic acids can also be obtained by reacting chlorinated mono- and polycarboxylic acids, anhydrides, acyl halides, and the like with olefinically unsaturated hydrocarbons or olefinically unsaturated substituted hydrocarbons such as the polyolefins and substituted polyolefins described hereinbefore in the manner described in U.S. Pat. No. 3,340,281, this patent being incorporated herein by reference.

The monocarboxylic and polycarboxylic acid anhydrides can be obtained by dehydrating the corresponding acids. Dehydration is readily accomplished by heating the acid to a temperature above about 70° C., preferably in the presence of a dehydration agent, e.g., acetic anhydride. Cyclic anhydrides are usually obtained from polycarboxylic acids having acid groups separated by no more than three carbon atoms such as substituted succinic or glutaric acid, whereas linear anhydrides are usually obtained from polycarboxylic acids having the acid groups separated by four or more carbon atoms.

The acid halides of the monocarboxylic and polycarboxylic acids can be prepared by the reaction of the acids or their anhydrides with a halogenating agent such as phosphorus tribromide, phosphorus oxychloride, phosphorus pentachloride, or thionyl chloride.

Esters of such acids can be prepared simply by the reaction of the acid, acid halide or anhydride with an alcohol or phenolic compound. Particularly useful are the lower alkyl and alkenyl alcohols such as methanol, ethanol, allyl alcohol, propanol, cyclohexanol, etc. Esterification reactions are usually promoted by the use of alkaline catalysts such as sodium hydroxide or alkoxide, or an acidic catalyst such as sulfuric acid or toluene sulfonic acid.

Hydrocarbyl-substituted succinic acids, and the anhydride, acid halide and ester derivatives thereof, can be prepared by reacting maleic anhydride with an olefin or a chlorinated hydrocarbon such as a chlorinated polyolefin. The reaction involves merely heating the two reactants at a temperature in the range of about 100° C. to about 300° C., preferably, about 100° C. to about 200° C. The product from this reaction is a hydrocarbyl-substituted succinic anhydride wherein the substituent is derived from the olefin or chlorinated hydrocarbon. The product may be hydrogenated to remove all or a portion of any ethylenically unsaturated covalent linkages by standard hydrogenation procedures, if desired. The hydrocarbyl-substituted succinic anhydrides may be hydrolyzed by treatment with water or steam to the corresponding acid and either the anhydride or the acid may be converted to the corresponding acid halide or ester by reacting with a phosphorus halide, phenol or alcohol.

Useful higher molecular weight hydrocarbyl-substituted succinic acids and anhydrides are represented by the formulae

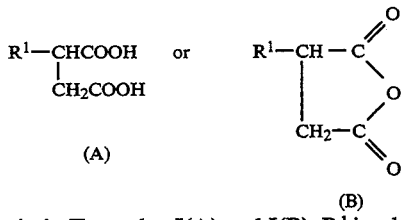

(I)

(A) (B)

wherein in Formulae I(A) and I(B), $R^1$ is a hydrocarbyl group of at least about 8 carbon atoms, and more preferably at least abut 10 carbon atoms.

Preferably, $R^1$ is an aliphatic or alicyclic hydrocarbyl group in which less than 10% of its carbon-bonds are unsaturated. Examples of such groups include 4-butylcyclohexyl, di(isobutyl), decyl, etc.

Another group of carboxylic acids useful in preparing the salts (A) of the present invention are the aromatic carboxylic acids. These acids can be represented by the formula

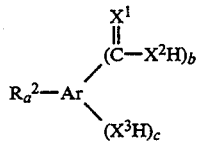

(II)

wherein in Formula II, $R^2$ is an aliphatic hydrocarbyl group of preferably about 4 to about 100 carbon atoms, a is a number in the range of from 0 to about 4; Ar is an aromatic group; $X^1$, $X^2$, and $X^3$ are independently sulfur or oxygen; b is a number in the range of from 1 to about 4; and c is a number in the range of from 0 to about 4, with the proviso that the sum of a, b, and c does not exceed the number of unsatisfied valences of Ar. Preferably, $R^2$ and a are such that there is an average of at least about 8 aliphatic carbon atoms provided by the $R^2$ groups in each compound represented by Formula II. When c is not zero, c is usually 1 to about 2.

The aromatic group Ar in Formula II may have the same structure as any of the aromatic groups Ar discussed below under the heading "Phenols". Examples of the aromatic groups that are useful herein include the polyvalent aromatic groups derived from benzene, naphthalene, anthracene, phenanthrene, indene, fluorene, biphenyl, and the like. Generally, the Ar groups used herein are polyvalent nuclei derived from benzene or naphthalene such as phenylenes and naphthylene, e.g., methylphenylenes, ethoxyphenylenes, nitrophenylenes, isopropylphenylenes, hydroxyphenylenes, mercaptophenylenes, N,N-diethylaminophenylenes, chlorophenylenes, dipropoxynaphthylenes, triethylnaphthylenes, and similar tri-, tetra-, pentavalent nuclei thereof, etc. These Ar groups may contain non-hydrocarbon substituents, for example, such diverse substituents as lower alkoxy, lower alkyl mercapto, nitro, halo, alkyl or alkenyl groups of less than about 4 carbon atoms, hydroxy, mercapto, and the like.

Examples of the $R^2$ groups in Formula III include butyl, isobutyl, pentyl, octyl, nonyl, dodecyl, docosyl, tetracontyl, 5-chlorohexyl, 4-ethoxypentyl, 4-hexenyl, 3-cyclohexyloctyl, 4-(p-chlorophenyl)-octyl, 2,3,5-trimethylheptyl, 4-ethyl-5-methyloctyl, and substituents derived from polymerized olefins such as polychloroprenes, polyethylenes, polypropylenes, polyisobutylenes, ethylene-propylene copolymers, chlorinated olefin polymers, oxidized ethylene-propylene copolymers, and the like.

Within the group defined by formula (II) in which c is not zero, a useful class of carboxylic acids are those of the formula

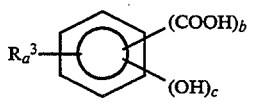

(III)

wherein in Formula III, $R^3$ is an aliphatic hydrocarbyl group preferably containing from about 4 to about 100 carbon atoms, a is a number in the range of from zero to about 4, preferably 1 to about 3; b is a number in the range of from 1 to about 4, preferably 1 to about 2, c is a number in the range of from 1 to about 4, preferably 1 to about 2, and more preferably 1; with the proviso that the sum of a, b and c does not exceed 6. Preferably, $R^3$ and a are such that the acid molecules contain at least an average of about 12 aliphatic carbon atoms in the aliphatic hydrocarbon substituents per acid molecule.

Also useful are the aliphatic hydrocarbon-substituted salicylic acids wherein each aliphatic hydrocarbon substituent contains an average of at least about 8 carbon atoms per substituent and 1 to 3 substituents per molecule. Salts prepared from such salicylic acids wherein the aliphatic hydrocarbon substituents are derived from polymerized olefins, particularly polymerized lower 1-mono-olefins such as polyethylene, polypropylene, polyisobutylene, ethylene/propylene copolymers and the like and having average carbon contents of about 12 to about 40 carbon atoms are particularly useful.

The aromatic carboxylic acids corresponding to Formulae II and III above are well known or can be prepared according to procedures known in the art. Carboxylic acids of the type illustrated by these formulae and processes for preparing their neutral and basic metal salts are well known and disclosed, for example, in U.S. Pat. Nos. 2,197,832; 2,197,835; 2,252,662; 2,252,664; 2,714,092; 3,410,798; and 3,595,791.

In one embodiment, the aliphatic carboxylic acids are preferred over aromatic carboxylic acids such as alkylated salicylic acids.

The carboxylic acid salts (A) of this invention may be oil-soluble, although oil-solubility is not a required feature. Component (A) may, for example, be dispersed, rather than dissolved or solubilized, in a lubricant formulation or concentrate additive. The number of carbon atoms present in the acid is important in contributing to the solubility of the salts (A). Usually, the number of carbon atoms in the carboxylic acid should be at least about 8 carbon atoms, and more preferably at least about 12 carbon atoms.

Preferred carboxylic acids and anhydrides for making the salts (A) are those which have a number average molecular weight of at least about 150 or which contain a hydrocarbyl group having at least about 10 carbon atoms, and have a number average molecular weight up to about 1,500, and preferably up to about 1,100. In one embodiment, the hydrocarbyl group has an Mn value up to about 600. Advantages that may be obtained by using metal salts derived from these carboxylic acids include greater compatibility with the alcohol fuel at the fuel-lubricant interface while providing rust and corrosion inhibition and detergency.

Sulfur-Containing Acids

The sulfur-containing acids useful in making salts (A) of the invention include the sulfonic, sulfamic, thiosulfonic, sulfinic, sulfenic, partial ester sulfuric, sulfurous and thiosulfuric acids. Generally they are salts of carbocyclic or aliphatic sulfonic acids.

The carbocyclic sulfonic acids include the mono- or polynuclear aromatic or cycloaliphatic compounds. The oil-soluble sulfonate can be represented for the most part by the following formula:

$$R^4_e—T_d—(SO_3)_f \qquad \text{(IV)}$$

In the above Formula IV, T is a cyclic nucleus such as, for example, benzene, naphthalene, anthracene, phenanthrene, diphenylene oxide, thianthrene, phenothioxine, diphenylene sulfide, phenothiazine, diphenyl oxide, diphenyl sulfide, diphenylamine, cyclohexane, petroleum naphthenes, decahydronaphthalene, cyclopentane, etc.; d is 0 or 1; $R^4$ is an aliphatic group such as alkyl, alkenyl, alkoxy, alkoxyalkyl, carboalkoxyalkyl, etc., provided that $R^4+T_d$ contains a total of at least about 15 carbon atoms. In other words, $R^4$ is an aliphatic hydrocarbyl group containing at least about 15 carbon atoms when d is 0. Examples of $R^4$ are alkyl, alkenyl, alkoxyalkyl, carboalkoxyalkyl, etc. Specific examples of $R^4$ when d is 0 are groups derived from petrolatum, saturated and unsaturated paraffin wax, and polyolefins, including polymerized $C_2$, $C_3$, $C_4$, $C_5$, $C_6$, etc., olefins containing from about 15 to about 140 or more carbon atoms. The groups T and $R^4$ in the above Formula IV can also contain other inorganic or organic substituents in addition to those enumerated above such as, for example, hydroxy, mercapto, halogen, nitro, amino, nitroso, sulfide, disulfide, etc. In Formula IV, e and f are at least 1.

The following are specific examples of oil-soluble sulfonic acids within the scope of Formula IV above, and it is to be understood that such examples serve also to illustrate the salts of such sulfonic acids useful in this invention. In other words, for every sulfonic acid enumerated it is intended that the corresponding neutral and basic metal salts thereof are also understood to be illustrated. Such sulfonic acids are mahogany sulfonic acids; bright stock sulfonic acids; sulfonic acids derived from lubricating oil fractions having a Saybolt viscosity from about 100 seconds at 100° F. to about 200 seconds at 210° F.; petrolatum sulfonic acids; paraffin wax sulfonic acids; hexapropylene sulfonic acids; tetraamylene sulfonic acids; polyisobutene sulfonic acids wherein the polyisobutene contains from about 20 to about 100 or more carbon atoms; etc.; cycloaliphatic sulfonic acids such as cetyl cyclopentyl sulfonic acids; lauryl cyclohexyl sulfonic acids; bis-(diisobutyl) cyclohexyl sulfonic acids; mono- or poly-wax-substituted cyclohexyl sulfonic acids, etc.; mono- and poly-wax-substituted sulfonic and polysulfonic acids of, e.g., benzene, naphthalene, phenol, diphenyl ether, naphthalene disulfide, diphenylamine, thiophene, alpha-chloronaphthalene, etc.; other substituted sulfonic acids such as alkyl benzene sulfonic acids (wherein the alkyl group has at least 8 carbons), cetylphenol mono-sulfide sulfonic acids, dicetyl thianthrene disulfonic acids, dilauryl beta naphthyl sulfonic acids, dicapryl nitronaphthalene sulfonic acids, and alkaryl sulfonic acids such as dodecyl benzene "bottoms" sulfonic acids.

The latter are acids derived from benzene which have been alkylated with propylene tetramers or isobutene trimers to introduce 1, 2, 3, or more branched-chain $C_{12}$ substituents on the benzene ring. Dodecyl benzene bottoms, principally mixtures of mono- and didodecyl benzenes, are available as by-products from the manufacture of household detergents. Similar products obtained from alkylation bottoms formed during manufacture of linear alkyl sulfonates (LAS) are also useful in making the sulfonates used in this invention.

The production of sulfonates from detergent manufactured by-products by reaction with, e.g., $SO_3$, is well known to those skilled in the art. See, for example, the article "Sulfonates" in Kirk-Othmer "Encyclopedia of Chemical Technology", Second Edition, Vol. 19, pp. 291 et seq., published by John Wiley & Sons, N.Y. (1969).

Other descriptions of neutral and basic sulfonate salts and techniques for making them can be found in the following U.S. Patents: U.S. Pat. Nos. 2,174,110; 2,174,506; 2,174,508; 2,193,824; 2,197,800; 2,202,781; 2,212,786; 2,213,360; 2,228,598; 2,233,676; 2,239,974; 2,263,312; 2,276,090; 2,276,097; 2,315,514; 2,319,121; 2,321,022; 2,333,568; 2,333,788; 2,335,359; 2,337,552; 2,346,568; 2,366,027; 2,374,193; 2,383,319; 3,312,618; 3,471,403; 3,488,284; 3,595,790; and 3,798,012. These patents are hereby incorporated by reference for their disclosures in this regard.

With respect to the sulfonic acids or salts thereof described herein and in the appended claims, it is intended herein to employ the term "petroleum sulfonic acids" or "petroleum sulfonates" to cover all sulfonic acids or the salts thereof derived from petroleum products. A useful group of petroleum sulfonic acids are the mahogany sulfonic acids (so called because of their reddish-brown color) obtained as a by-product from the manufacture of petroleum white oils by a sulfuric acid process.

Generally neutral and basic salts of the above-described synthetic and petroleum sulfonic acids are useful in the practice of this invention.

Other patents specifically describing techniques for making basic salts of the above-described sulfonic acids, carboxylic acids, and mixtures of any two or more of these include U.S. Pat. Nos. 2,501,731; 2,616,904; 2,616,905; 2,616,906; 2,616,911; 2,616,924; 2,616,925; 2,617,049; 2,777,874; 3,027,325; 3,256,186; 3,282,835; 3,384,585; 3,373,108; 3,365,396; 3,342,733; 3,320,162; 3,312,618; 3,318,809; 3,471,403; 3,488,284; 3,595,790; and 3,629,109. The disclosures of these patents are hereby incorporated in this present specification for their disclosures in this regard as well as for their disclosure of specific suitable basic metal salts.

Preferred sulfur-containing acids for making the salts (A) are those which have a number average molecular weight of at least about 200, and preferably at least about 300, up to about 1,500, preferably up to about 1,100, and more preferably up to about 500. Advantages that may be obtained by using metal salts derived from these sulfur-containing acids include those mentioned with regard to the salts derived from carboxylic acids in their preferred molecular weight ranges, namely greater compatibility with the alcohol fuel, etc.

Phosphorus-Containing Acids

The phosphorus-containing acids useful in making the salts (A) of the invention can be represented by the formula

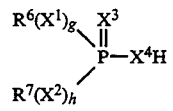

(V)

wherein in Formula V, $X^1$, $X^2$, $X^3$ and $X^4$ are independently oxygen or sulfur; g and h are independently zero or one, and $R^6$ and $R^7$ are independently hydrocarbyl groups.

Preferred acids of the formula

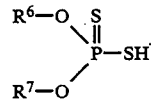

(V(A))

are readily obtainable by the reaction of phosphorus pentasulfide ($P_2S_5$) and an alcohol or a phenol. The reaction involves mixing at a temperature of about 20° C. to about 200° C. four moles of alcohol or a phenol with one mole of phosphorus pentasulfide. Hydrogen sulfide is liberated in this reaction. The oxygen-containing analogs of these acids are conveniently prepared by treating the dithioic acid with water or steam which, in effect, replaces one or both of the sulfur atoms with oxygen.

Preferred phosphorus-containing acids are those which contain sulfur. These preferred acids preferably include those acids wherein at least one $X^3$ or $X^4$ is sulfur, and more preferably both $X^3$ and $X^4$ are sulfur, at least one $X^1$ or $X^2$ is oxygen or sulfur, more preferably both $X^1$ and $X^2$ are oxygen, and g and h are each 1. Mixtures of these acids may be employed in accordance with this invention.

$R^7$ and $R^8$ are independently hydrocarbyl groups that are preferably free from acetylenic unsaturation and usually also from ethylenic unsaturation and preferably have from about 1 to about 50 carbon atoms, more preferably from about 1 to about 30 carbon atoms, and more preferably from about 3 to about 18 carbon atoms, more preferably from about 4 to about 8 carbon atoms. Each $R^7$ and $R^8$ can be the same as the other, although they may be different and either or both may be mixtures. Examples of preferred $R^7$ and $R^8$ groups include t-butyl, isobutyl, amyl, isooctyl, decyl, dodecyl, eicosyl, 2-pentenyl, dodecenyl, phenyl, naphthyl, alkylphenyl, alkylnaphthyl, phenylalkyl, naphthylalkyl, alkylphenylalkyl, alkylnaphthylalkyl, and the like.

Phenols

The phenols useful in making the salts (A) of the invention can be represented by the formula $$R^8_i—Ar—(OH)_j \quad (VI)$$

wherein in Formula VI, $R^8$ is a hydrocarbyl group of from abut 4 to about 400 carbon atoms; Ar is an aromatic group; i and j are independently numbers of at least one, the sum of i and j being in the range of two up to the number of displaceable hydrogens on the aromatic nucleus or nuclei of Ar. Preferably, i and j are independently numbers in the range of 1 to about 4, more preferably 1 to about 2. $R^8$ and i are preferably such that there is an average of at least about 8 aliphatic carbon atoms provided by the $R^8$ groups for each phenol compound represented by Formula VI.

While the term "phenol" is used herein, it is to be understood that this term is not intended to limit the aromatic group of the phenol to benzene. Accordingly, it is to be understood that the aromatic group as represented by "Ar" in Formula VI, as well as elsewhere in other formulae in-this specification and in the appended claims, can be mononuclear such as a phenyl, a pyridyl, a thienyl, or polynuclear. The poly-nuclear groups can be of the fused type wherein an aromatic nucleus is fused at two points to another nucleus such as found in naphthyl, anthranyl, azanaphthyl, etc. The polynuclear group can also be of the linked type wherein at least two nuclei (either mononuclear or polynuclear) are linked through Bridging linkages to each other. These bridging linkages can be chosen from the group consisting of carbon-to-carbon single bonds, ether linkages, keto linkages, sulfide linkages, polysulfide linkages of 2 to about 6 sulfur atoms, sulfinyl linkages, sulfonyl linkages, alkylene linkages, alkylidene linkages, lower alkylene ether linkages, alkylene keto linkages, lower alkylene sulfur linkages, lower alkylene polysulfide linkages of 2 to about 6 carbon atoms, amino linkages, polyamino linkages and mixtures of such divalent bridging linkages. In certain instances, more than one bridging linkage can be present in Ar between two aromatic nuclei; for example, a fluorene nucleus having two benzene nuclei linked by both a methylene linkage and a covalent bond. Such a nucleus may be considered to have three nuclei but only two of them are aromatic. Normally, however, Ar will contain only carbon atoms in the aromatic nuclei per se (plus any alkyl or alkoxy substituent present).

The number of aromatic nuclei, fused, linked or both, in Ar can play a role in determining the integer values of i and j in Formula VI. For example, when Ar contains a single aromatic nucleus, the sum of i and j is from 2 to 6. When Ar contains two aromatic nuclei, the sum of i and j is from 2 to 10. With a tri-nuclear Ar moiety, the sum of i and j is from 2 to 15. The value for the sum of i and j is limited by the fact that it cannot exceed the total number of displaceable hydrogens on the aromatic nucleus or nuclei of Ar.

The single ring aromatic nucleus which can be the Ar group can be represented by the general formula $$ar(Q)_m$$

wherein ar represents a single ring aromatic nucleus (e.g., benzene) of 4 to 10 carbons, each Q independently represents a lower alkyl group, lower alkoxy group, nitro group, or halogen atom, and m is a number in the range of from 0 to 4. Halogen atoms include fluorine, chlorine, bromine and iodine atoms; usually, the halogen atoms are fluorine and chlorine atoms.

For such reasons as cost, availability, performance, etc., the Ar group is normally a benzene nucleus, lower alkylene bridged benzene nucleus, or a naphthalene nucleus.

The $R^8$ group in Formula VI is a hydrocarbyl group that is directly bonded to the aromatic group Ar. $R^8$ preferably contains about 6 to about 80 carbon atoms, preferably about 6 to about 30 carbon atoms, more preferably about 8 to about 25 carbon atoms, and advantageously about 8 to about 15 carbon atoms. Examples of $R^8$ groups include butyl, isobutyl, pentyl, octyl, nonyl, dodecyl, dodecosyl, tetracontyl, 5-chlorohexyl, 4-ethoxypentyl, 4-hexenyl, 3-cyclohexyloctyl, 4-(chlorophenyl)-octyl, 2,3,5-trimethylheptyl, 4-ethyl-5-methyloctyl, and substituents derived from polymerized olefins such as polychloroprenes, polyethylenes, polypropylenes, polyisobutylenes, ethylene-propylene copolymers, chlorinated olefin polymers, oxidized ethylene-propylene copolymers, propylene tetramer and tri(isobutene).

The attachment of the hydrocarbyl group $R^8$ to the aromatic group Ar can be accomplished by a number of techniques well known to those skilled in the art. Methods and conditions for carrying out such reactions are well known to those skilled in the art. See, for example, the discussion in the article entitled, "Alkylation of Phenols" in "Kirk-Othmer Encyclopedia of Chemical Technology", Second Edition, Vol. 1, pages 894–895, Interscience Publishers, a division of John Wiley and Company, New York, 1963, which is incorporated herein by reference. Other equally appropriate and convenient techniques for attaching the hydrocarbyl group $R^8$ to the aromatic group Ar will be apparent to those skilled in the art, As will be appreciated from inspection of Formula VI, the phenol group of the salt (A) of this invention contains at least one $R^8$ group, as defined above, and OH. Each of the foregoing must be attached to a carbon atom which is a part of an aromatic nucleus in the Ar group. They need not, however, each be attached to the same aromatic ring if more than one aromatic nucleus is present in the Ar group.

The ratio of metal to acidic organic compound in the above-described neutral or basic salts is often expressed in terms of "conversion ratios". A "conversion ratio" is the weight of metal present in the basic salt relative to the metal present in the corresponding neutral salt multiplied by 100.

Component (A) typically has a conversion ratio in the range from about 100 to about 3,000. Conversion ratios falling within more specific ranges are preferred for metal salts of certain art recognized groups of acid organic compounds, such as carboxylic acids and sulfur-containing acids.

In one preferred embodiment, the metal carboxylates which may be used as component (A) generally have a conversion ratio in the range from abut 100 to about 2,000, preferably from about 100 to about 1,500, and more preferably from about 100 to about 1,000. Certain advantages are often obtained when a low conversion, say in the range from about 100 to about 1,000, metal carboxylate is utilized. These preferred metal carboxylates have good compatibility with alcohol fuels such as methanol and provide rust and corrosion inhibition properties.

In an advantageous embodiment, component (A) prepared from sulfur-containing acids, such as the above-described sulfonates, have a conversion ratio in the range from about 100 to about 3,000, more preferably from about 100 to about 1,500, and even more preferably from about 100 to about 600. Lubricant formulations of the present invention containing these lower conversion ratio overbased materials as component (A), especially conversion ratios less than about 600, have been found to have remarkably better performance in rust and corrosion inhibition, particularly in the humidity cabinet test described in ASTM D1748 published by the American Society for Testing Materials, which is hereby incorporated herein by reference. Such overbased materials of component (A) preferably have a total base number less than about 300, and more preferably less than about 200. The usefulness of the ASTM humidity cabinet test for predicting performance in rust and corrosion inhibition in methanol-fueled engines is described, for example, in Chamberlin et al, "Lubrication Experience in Methanol-Fueled Engines Under Short-Trip Service Conditions", SAE Paper No. 831701 presented at the SAE Fuels and Lubricants Meeting, San Francisco, in November, 1983, which is hereby incorporated herein by reference.

In a preferred embodiment, component (A) comprises a low conversion metal overbased sulfur-containing material having a conversion ratio in the range from about 100 to about 600 and a total base number less than about 200.

Another example of a preferred embodiment is when component (A) comprises at least one magnesium overbased alkyl benzene sulfonate having a conversion ratio in the range from about 110 to about 300 and a total base number less than about 110. This embodiment provides superior rust and corrosion inhibition properties.

Mixtures of metal salts derived from more than one type of acid, such as a mixed metal salt of one or more carboxylates with each other or with one or more sulfur-containing acids, or one or more sulfur-containing acids combined with each other, may also be used as component (A) metal salts.

(B) Hydrocarbyl-Substituted Ashless Dispersant

The lubricants and additive concentrates of the present invention contain at least one hydrocarbyl-substituted ashless dispersant (also referred to hereinafter as simply "ashless dispersant"). Ashless dispersants are referred to as being ashless despite the fact that, depending on their constitution, the dispersants may upon combustion yield a non- volatile material such as boric oxide or phosphorus pentoxide. However, the ashless dispersants do not ordinarily contain metal, and therefore do not yield a metal-containing ash upon combustion. Many types of ashless dispersants are known in the prior art, and any of these are suitable for use in the compositions of the present invention. The ashless dispersants which can be utilized in the compositions of the present invention include the following: carboxylic dispersants; amine dispersants; Mannich dispersants; and carboxylic, amine or Mannich dispersants post-treated with such reagents as urea, thiourea, carbon disulfide, aldehydes, ketones, carboxylic acids, hydrocarbon-substituted succinic anhydrides, nitriles, epoxides, boron compounds, phosphorus compounds, etc.

The amine dispersants are reaction products of relatively high molecular weight aliphatic or alicyclic halides with amines or are reaction products of a reactant containing at least one hydroxy group with a polyamine reactant containing at least one primary or secondary amino group, preferably polyalkylene polyamines. Amine dispersants are known and have been described in the prior art such as in U.S. Pat. Nos. 3,275,554; 3,438,757; 3,454,555; and 3,565,804. Mannich dispersants are reaction products of alkyl phenols in which the alkyl group contains at least abut 18 carbon atoms with aldehydes (especially formaldehyde) and amines (especially polyalkylene polyamines). The materials described in the following patents are illustrative of Mannich dispersants: U.S. Pat. Nos. 3,413,347; 3,697,574; 3,725,277; 3,725,480; 3,726,882; and 4,454,059.

Products obtained by post-treating the carboxylic, amine or Mannich dispersants with such reagents as urea, thiourea, carbon disulfide, aldehydes, ketones, carboxylic acids, hydrocarbon-substituted succinic anhydrides, nitriles, epoxides, boron compounds, phosphorus compounds or the like are useful ashless dispersants. Exemplary materials of this kind are described in the following U.S. Pat. Nos. 3,036,003; 3,200,107; 3,254,025; 3,278,550; 3,281,428; 3,282,955; 3,366,569; 3,373,111; 3,442,808; 3,455,832; 3,493,520; 3,513,093; 3,539,633; 3,579,450; 3,600,372; 3,639,242; 3,649,659; 3,703,536; and 3,708,522.

All of the above-noted patents are incorporated by reference herein for their disclosures of ashless dispersants.

The carboxylic dispersants generally are reaction products of substituted carboxylic acylating agents such as substituted carboxylic acids or derivatives thereof with (a) amines characterized by the presence within their structure of at least one >NH group, (b) organic hydroxy compounds such as hydroxy aromatic compounds and alcohols, (c) basic inorganic materials such as reactive metal or reactive metal compounds, and (d) combinations of two or more of (a) through (c). The dispersants which are obtained by the reaction of a substituted carboxylic acylating agent with an amine compound often are referred to as "acylated amine dispersants" or "carboxylic imide dispersants" such as succinimide dispersants. The ashless dispersants obtained by the reaction of a substituted carboxylic acylating agent with an alcohol or phenol generally are referred to as carboxylic ester dispersants.

The substituted carboxylic acylating agent may be derived from a monocarboxylic acid or a polycarboxylic acid. Polycarboxylic acids generally are preferred. The acylating agents may be a carboxylic acid or derivatives of the carboxylic acid such as the halides, esters, anhydrides, etc. The free carboxylic acids or the anhydrides of polycarboxylic acids are preferred acylating agents.

In one embodiment, the ashless dispersants utilized in the present invention are the acylated amines or dispersants obtained by reaction of a carboxylic acylating agent with at least one amine containing at least one hydrogen attached to a nitrogen group. In one preferred embodiment, the acylating agent is a hydro-carbon-substituted succinic acid acylating agent.

The nitrogen-containing carboxylic dispersants useful in the present invention are known in the art and have been described in many U.S. patents including

| | | |
|---|---|---|
| 3,172,892 | 3,341,542 | 3,630,904 |
| 3,215,707 | 3,444,170 | 3,632,511 |
| 3,219,666 | 3,454,607 | 3,787,374 |
| 3,316,177 | 3,541,012 | 4,234,435 |

The above U.S. patents are expressly incorporated herein by reference for their teaching of the preparation of nitrogen-containing carboxylic dispersants.

Preferably, the nitrogen-containing carboxylic dispersants are produced by reacting at least one substituted succinic acylating agent with at least one amine compound containing at least one HN<group, and wherein said acylating agent consists of substituent groups and succinic groups wherein the substituent groups are derived from a polyalkene characterized by an Mn value (number average molecular weight) of at least about 300, and more generally from about 600 to about 1,500, preferably not more than about 1,100. In one embodiment, the Mn value is not more than about 1,000. Generally, the reaction involves from about 0.5 equivalent to about 2 moles of the amine compound per equivalent of acylating agent.

Similarly, the carboxylic ester dispersants are prepared by reacting the carboxylic acylating agents described above with one or more alcohols or hydroxy aromatic compounds in ratios of from about 0.5 equivalent to about 2 moles of hydroxy compound per equivalent of acylating agent. The preparation of carboxylic ester dispersant is described in the prior art such as U.S. Pat. Nos. 3,522,179 and 4,234,435.

In one embodiment, component (B) is at least one ester of a hydrocarbyl-substituted mono- or polycarboxylic acid or anhydride and a polyhydric alcohol or at least one such ester post-treated with at least one amine. The ester of component (B) is preferably oil-soluble.

The hydrocarbyl substituent of the mono- or polycarboxylic acid or anhydride is a group which has an Mn value of at least about 300, and more generally at least about 600 and not more than about 1,500, and preferably not more than about 1,100. In one embodiment, the hydrocarbyl substituent has an Mn value of not more than about 1,000. In another embodiment, the hydrocarbyl substituent has an Mn value of not more than about 700. Preferably, the hydrocarbyl substituent contains at least about 18 aliphatic carbon atoms.

The hydrocarbyl substituent of (B) preferably comprises a polymerized mono-olefin.

Preferred ashless dispersants for use in the present invention include carboxylic esters (B-1) produced by reacting (B-1-a) at least one substituted succinic acylating agent with (B-1-b) at least one alcohol or aromatic hydroxy compounds of the general formula $$R_1(OH)_m \qquad \text{(VII)}$$

wherein $R_1$ is a monovalent or polyvalent organic group joined to the —OH groups through carbon bonds, and m is an integer of from 1 to about 10.

The substituted succinic acylating agent (B-1) utilized in the preparation of the carboxylic esters and acylated amines can be characterized by the presence within its structure of two groups or moieties. The first group or moiety is referred to hereinafter, for convenience, as the "substituent group(s)" and is derived from a polyalkene. The polyalkene from which the substituent is derived is characterized as containing at least about 8 carbon atoms, and, more often, at least about 20 carbon atoms. The substituent groups are generally characterized by the molecular weight ranges described above for the "hydrocarbyl substituent". In a preferred embodiment, the substituent groups of the acylating agent are derived from polyalkenes which are characterized by Mw/Mn value of about 1.5 to about 4.5. The term Mw refers to weight average molecular weight.

Gel permeation chromatography (GPC) is a method which provides both weight average and number average molecular weights as well as the entire molecular weight distribution of the polymers. For purpose of this invention a series of fractionated polymers of isobutene, polyisobutene, is used as the calibration standard in the GPC.

The techniques for determining Mn and Mw values of polymers are well known and are described in numerous books and articles. For example, methods for the determination of Mn and molecular weight distribution of polymers is described in W. W. Yan, J. J. Kirkland and D. D. Bly, "Modern Size Exclusion Liquid Chromatographs", J. Wiley & Sons, Inc., 1979.

Obviously, preparing polyalkenes as described above which meet the various criteria for Mn and Mw/Mn is within the skill of the art. Techniques readily apparent to those in the art include controlling polymerization temperatures, regulating the amount and type of polymerization initiator and/or catalyst, employing chain terminating groups in the polymerization procedure, and the like. Other conventional techniques such as stripping (including vacuum stripping) a very light end and/or oxidatively or mechanically degrading high molecular weight polyalkene to produce lower molecular weight polyalkenes can also be used.

The second group or moiety in the preferred acylating agent is referred to herein as the "succinic group(s)". The succinic groups are those groups characterized by the structure

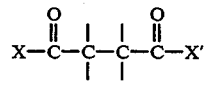

(VIII)

wherein X and X' are the same or different provided at least one of X and X' is such that the substituted succinic acylating agent can function as carbexylic acylating agents. That is, at least one of X and X' must be such that the substituted acylating agent can form amides or amine salts with amino compounds, and otherwise function as a conventional carboxylic acid acylating agents. Transamidation reactions are considered, for purposes of this invention, as conventional acylating reactions.

Thus, X and/or X' is usually —OH, —O—hydrocarbyl, —O—$M^+$ where $M^+$ represents one equivalent of a metal, ammonium or amine cation, —$NH_2$, —Cl, —Br, and together, X and X' can be —O— so as to form the anhydride. The specific identity of any X or X' group which is not one of the above is not critical so long as its presence does not prevent the remaining group from entering into acylation reactions. Preferably, however, X and X' are each such that both carboxyl functions of the succinic group (i.e., both —C(O)X and —C(O)X' can enter into acylation reactions.

One of the unsatisfied valences in the grouping

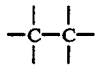

of Formula VIII forms a carbon-to-carbon bond with a carbon atom in the substituent group. While other such unsatisfied valence may be satisfied by a similar bond with the same or different substituent group, all but the said one such valence is usually satisfied by hydrogen; i.e., —H.

Polyalkenes having the Mn and Mw values discussed above are known in the art and can be prepared according to conventional procedures. For example, some of these polyalkenes are described and exemplified in U.S. Pat. No. 4,234,435, and the disclosure of this patent relative to such polyalkenes is hereby incorporated by reference. Several such polyalkenes, especially polybutenes, are commercially available.

In one preferred embodiment, the succinic groups will normally correspond to the formula

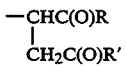

(IX)

wherein R and R' are each independently selected from the group consisting of —OH, —Cl, —O—, and lower alkyl, and when taken together, R and R' are —O—. In the latter case, the succinic group is a succinic anhydride group. All the succinic groups in a particular succinic acylating agent need not be the same, but they can be the same. Preferably, the succinic groups will correspond to

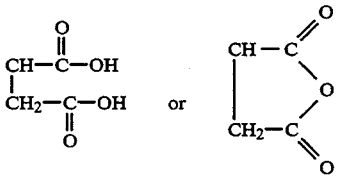

(X)

(A) (B)

and mixtures of (X(A)) and (X(B)).

The polyalkenes from which the substituent groups are derived are homopolymers and interpolymers of polymerizable olefin monomers of 2 to about 16 carbon atoms; usually 2 to about 12 carbon atoms. The interpolymers are those in which two or more olefin monomers are interpolymerized according to well-known conventional procedures to form polyalkenes having units within their structure derived from each of said two or more olefin monomers. Thus, "interpolymer(s)" as used herein is inclusive of copolymers, terpolymers, tetrapolymers, and the like. As will be apparent to those of ordinary skill in the art, the polyalkenes from which the substituent groups are derived are often conventionally referred to as "polyolefin(s)".

The olefin monomers from which the polyalkenes are derived are polymerizable olefin monomers characterized by the presence of one or more ethylenically unsaturated groups (i.e., >C=C<); that is, they are monoolefinic monomers such as ethylene, propylene, butene-1, isobutene, octene-1, and decene-1 or polyolefinic monomers (usually diolefinic monomers) such as butadiene-1,3 and isoprene.

These olefin monomers are usually polymerizable terminal olefins; that is, olefins characterized by the presence in their structure of the group $>C{=}CH_2$. However, polymerizable internal olefin monomers (sometimes referred to in the literature as medial olefins) characterized by the presence within their structure of the group

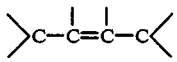

can also be used to form the polyalkenes. When internal olefin monomers are employed, they normally will be employed with terminal olefins to produce polyalkenes which are interpolymers. For purposes of this invention, when a particular polymerized olefin monomer can be classified as both a terminal olefin and an internal olefin, it will be deemed to be a terminal olefin. Thus, pentadiene-1,3 (i.e., piperylene) is deemed to be a terminal olefin for purposes of this invention.

While the polyalkenes from which the substituent groups of the succinic acylating agents are derived generally are hydrocarbon groups, they can contain non-hydrocarbon substituents such as lower alkoxy, lower alkyl mercapto, hydroxy, mercapto, nitro, halo, cyano, carboalkoxy, (where alkoxy is usually lower alkoxy), alkanoyloxy, and the like provided the non-hydrocarbon substituents do not substantially interfere with formation of the substituted succinic acid acylating agents of this invention. When present, such non-hydrocarbon groups normally will not contribute more than about 10% by weight of the total weight of the polyalkenes. Since the polyalkene can contain such non-hydrocarbon substituents, it is apparent that the olefin monomers from which the polyalkenes are made can also contain such substituents. Normally, however, as a matter of practicality and expense, the olefin monomers and the polyalkenes will be free from non-hydrocarbon groups, except chloro groups which usually facilitate the formation of the substituted succinic acylating agents of this invention.

Although the polyalkenes may include aromatic groups (especially phenyl groups and lower alkyl- and/or lower alkoxy-substituted phenyl groups such as para-(tert-butyl)phenyl) and cycloaliphatic groups such as would be obtained from polymerizable cyclic olefins or cycloaliphatic substituted-polymerizable acyclic olefins, the polyalkenes usually will be free from such groups. Nevertheless, polyalkenes derived from interpolymers of both 1,3-dienes and styrenes such as butadiene-1,3 and styrene or para-(tert-butyl)styrene are exceptions to this generalization. Again, because aromatic and cycloaliphatic groups can be present, the olefin monomers from which the polyalkenes are prepared can contain aromatic and cycloaliphatic groups.

There is a general preference for aliphatic, hydrocarbon polyalkenes free from aromatic and cycloaliphatic groups. Within this general preference, there is a further preference for polyalkenes which are derived from the group consisting of homopolymers and interpolymers of terminal hydrocarbon olefins of 2 to about 16 carbon atoms. This further preference is qualified by the proviso that, while interpolymers of terminal olefins are usually preferred, interpolymers optionally containing up to about 40% of polymer units derived from internal olefins of up to about 16 carbon atocommercially available mixtures of fatty acids, such as tall oil fatty acids, etc. Anhydrides and lower alkyl esters of these acids can also be used. Mixtures of two or more such acids can also be used. An extensive discussion of these acids is found in Kirk-Othmer "Encyclopedia of Chemical Technology" Third Edition, 1978, John Wiley & Sons New York, pp. 814–871, which is incorporated herein by reference.

Additional monocarboxylic acids include substituted aliphatic acids, i.e., acids having one or more lower acyclic pendant hydrocarbyl groups. Such acids often contain a principal chain having from about 14 to about 20 saturated aliphatic carbon atoms and at least one, but usually no more than about four, pendant acyclic hydrocarbyl groups. The principal chain of the acid is exemplified by groups derived from tetradecane, diene-1,3; pentadiene-1,4; isoprene; hexadiene-1,5; 2-chlorobutadiene- 1,3; 2-methyl-heptene-1; 3-cyclo-hexylbutene-1; 2-methyl- pentene-1; styrene; 2,4-dichlorostyrene; divinylbenzene; vinyl acetate; allyl alcohol; 1-methyl-vinyl acetate; acrylonitrile; ethyl acrylate; methyl methacrylate; ethyl vinyl ether; and methyl vinyl ketone. Of these, the hydrocarbon polymerizable monomers are preferred and, of these hydrocarbon monomers, the terminal olefin monomers are particularly preferred.

Specific examples of polyalkenes include polypropylenes, polybutenes, polydecene, ethylene-propylene copolymers, styrene-isobutene copolymers, isobutene-butadiene-1,3 copolymers, propene-isoprene copolymers, isobutene-chloroprene copolymers, isobutene-(paramethyl)-styrene copolymers, copolymers of hexene-1 with hexadiene-1,3, copolymers of octene-1 with hexene-1, copolymers of heptene-1 with pentene-1, copolymers of 3-methyl-butene-1 with octene-1, copolymers of 3,3-di-methyl-pentene-1 with hexene-1, and terpolymers of isobutene, styrene and piperylene. More specific examples of such interpolymers include copolymer of 95% (by weight) of isobutene with 5% (by weight) of styrene; terpolymer of 98% of isobutene with 1% of piperylene and 1% of chloroprene; terpolymer of 95% of isobutene with 2% of butene-1 and 3% of hexene-1; terpolymer of 60% of isobutene with 20% of pentene-1 and 20% of octene-1; copolymer of 80% of hexene-1 and 20% of heptene-1; terpolymer of 90% of isobutene with 2% of cyclohexene and 8% of propylene; and copolymer of 80% of ethylene and 20% of propylene. A preferred source of polyalkenes are the poly(isobutene)s obtained by polymerization of $C_4$ refinery stream having a butene content of about 35 to about 75% by weight and an isobutene content of about 30 to about 60% by weight in the presence of a Lewis acid catalyst such as aluminum trichloride or boron trifluoride. These polybutenes contain predominantly (greater than about 80% of the total repeating units) of isobutene (isobutylene) repeating units of the configuration

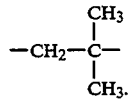

In preparing the substituted succinic acylating agents (B-1-a), one or more of the above-described polyalkenes is reacted with one or more acidic reactants selected from the group consisting of maleic or fumaric reactants of the general formula $$X(O)C—CH=CH—C(O)X' \quad (XI)$$

wherein X and X' are as defined hereinbefore in Formula VIII. Preferably the maleic and fumaric reactants will be one or more compounds corresponding to the formula $$RC(O)—CH=CH—C(O)R' \quad (XII)$$

wherein R and R' are as previously defined in Formula IX herein. Ordinarily, the maleic or fumaric reactants will be maleic acid, fumaric acid, maleic anhydride, or a mixture of two or more of these. The maleic reactants are usually preferred over the fumaric reactants because the former are more readily available and are, in general, more readily reacted with the polyalkenes (or derivatives thereof) to prepare the substituted succinic acylating agents of the present invention. The especially preferred reactants are maleic acid, maleic anhydride, and mixtures of these. Due to availability and ease of reaction, maleic anhydride will usually be employed.

The one or more polyalkenes and one or more maleic or fumaric reactants can be reacted according to any of several known procedures in order to produce the substituted succinic acylating agents useful in the present invention. For convenience and brevity, the term "maleic reactant" is often used hereinafter. When used, it should be understood that the term is generic to acidic reactants selected from maleic and fumaric reactants corresponding to Formulae (XI) and (XII) above, including a mixture of such reactants.

One procedure for preparing the substituted succinic acylating agents (B-1-a) is illustrated, in part, in U.S. Pat. No. 3,219,666 (Norman et al) which is expressly incorporated herein by reference for its teachings in regard to preparing succinic acylating agents. This procedure is conveniently designated as the "two-step procedure". It involves first chlorinating the polyalkene until there is an average of at least about one chloro group for each molecular weight of polyalkene. (For purposes of this invention, the molecular weight of the polyalkene is the weight corresponding to the Mn value.) Chlorination involves merely contacting the polyalkene with chlorine gas until the desired amount of chlorine is incorporated into the chlorinated polyalkene. Chlorination is generally carried out at a temperature of about 75° C. to about 125° C. If a diluent is used in the chlorination procedure, it should be one which is not itself readily subject to further chlorination. Poly- and perchlorinated and/or fluorinated alkanes and benzenes are examples of suitable diluents.

The second step in the two-step chlorination procedure is to react the chlorinated polyalkene with the maleic reactant at a temperature usually within the range of about 100° C. to about 200° C. The mole ratio of chlorinated polyalkene to maleic reactant is usually at least about 1:1.3. (In this application, a mole of chlorinated polyalkene is that weight of chlorinated polyalkene corresponding to the Mn value of the unchlorinated polyalkene.) However, a stoichiometric excess of maleic reactant can be used, for example, a mole ratio of 1:2. More than one mole of maleic reactant may react per molecule of chlorinated polyalkene. Because of such situations, it is better to describe the ratio of chlorinated polyalkene to maleic reactant in terms of equivalents. (An equivalent weight of chlorinated polyalkene, for purposes of this invention, is the weight corresponding to the Mn value divided by the average number of chloro groups per molecule of chlorinated polyalkene while the equivalent weight of a maleic reactant is its molecular weight.) Thus, the ratio of chlorinated polyalkene to maleic reactant will normally be such as to provide at least about 1.3 equivalents of maleic reactant for each mole of chlorinated polyalkene. Unreacted excess maleic reactant may be stripped from the reaction product, usually under vacuum, or reacted during a further stage of the process as explained below.

The resulting polyalkenyl-substituted succinic acylating agent is, optionally, again chlorinated if the desired number of succinic groups are not present in the product. If there is present, at the time of this subsequent chlorination, any excess maleic reactant from the second step, the excess will react as additional chlorine is introduced during the subsequent chlorination. Otherwise, additional maleic reactant is introduced during and/or subsequent to the additional chlorination step. This technique can be repeated until the total number of succinic groups per equivalent weight of substituent groups reaches the desired level.

Another procedure for preparing the substituted succinic acid acylating agents (B-1-a) utilizes a process described in U.S. Pat. No. 3,912,764 (Palmer) and U.K. Patent 1,440,219, both of which are expressly incorporated herein by reference for their teachings in regard to that process. According to that process, the polyalkene and the maleic reactant are first reacted by heating them together in a "direct alkylation" procedure. When the direct alkylation step is completed, chlorine is introduced into the reaction mixture to promote reaction of the remaining unreacted maleic reactants. According to the patents, 0.3 to 2 or more moles of maleic anhydride are used in the reaction for each mole of olefin polymer; i.e., polyalkene. The direct alkylation step is conducted at temperatures of 180° C. to 250° C. During the chlorine-introducing stage, a temperature of 160° C. to 225° C. is employed. In utilizing this process to prepare the substituted succinic acylating agents, it is necessary to use sufficient maleic reactant and chlorine to incorporate at least 1.3 succinic groups into the final product, i.e., the substituted succinic acylating agent, for each equivalent weight of polyalkene, i.e., reacted polyalkenyl in final product.

Other processes for preparing the acylating agents (B-1-a) are also described in the prior art. U.S. Pat. No. 4,110,349 (Cohen) describes a two-step process and the disclosure of U.S. Pat. No. 4,110,349 relating to the two-step process for preparing acylating agent is hereby incorporated by reference.

One preferred process for preparing the substituted succinic acylating agents (B-1-a) from the standpoint of efficiency, overall economy, and the performance of the acylating agents thus produced, as well as the performance of the derivatives thereof, is the so-called "one-step" process. This process is described in U.S. Pat. Nos. 3,215,707 (Rense) and 3,231,587 (Rense). Both are expressly incorporated herein by reference for their teachings in regard to that process.

Basically, the one-step process involves preparing a mixture of the polyalkene and the maleic reactant containing the necessary amounts of both to provide the desired substituted succinic acylating agents. This means that there must be at least 1.3 moles of maleic reactant for each mole of polyalkene in order that there can be at least 1.3 succinic groups for each equivalent weight of substituent groups. Chlorine is then introduced into the mixture, usually by passing chlorine gas through the mixture with agitation, while maintaining a temperature of at least about 140° C.

A variation on this process involves adding additional maleic reactant during or subsequent to the chlorine introduction but, for reasons explained in U.S. Pat. Nos. 3,215,707 and 3,231,587, this variation is presently not as preferred as the situation where all the polyalkene and all the maleic reactant are first mixed before the introduction of chlorine.

Usually, where the polyalkene is sufficiently fluid at 140° C. and above, there is no need to utilize an additional substantially inert, normally liquid solvent/diluent in the one-step process. However, as explained hereinbefore, if a solvent/diluent is employed, it is preferably one that resists chlorination. Again, the poly- and per-chlorinated and/or -fluorinated alkanes, cycloalkanes, and benzenes can be used for this purpose.

Chlorine may be introduced continuously or intermittently during the one-step process. The rate of introduction of the chlorine is not critical although, for maximum utilization of the chlorine, the rate should be about the same as the rate of consumption of chlorine in the course of the reaction. When the introduction rate of chlorine exceeds the rate of consumption, chlorine is evolved from the reaction mixture. It is often advantageous to use a closed system, including superatmospheric pressure, in order to prevent loss of chlorine and maleic reactant so as to maximize reactant utilization.

The minimum temperature at which the reaction in the one-step process takes place at a reasonable rate is about 140° C. Thus, the minimum temperature at which the process is normally carried out is in the neighborhood of 140° C. The preferred temperature range is usually between about 160° C. and about 220° C. Higher temperatures such as 250° C. or even higher may be used but usually with little advantage. In fact, temperatures in excess of 220° C. are often disadvantageous with respect to preparing the particular acylated succinic compositions of this invention because they tend to "crack" the polyalkenes (that is, reduce their molecular weight by thermal degradation) and/or decompose the maleic reactant. For this reason, maximum temperatures of about 200° C. to about 210° C. are normally not exceeded. The upper limit of the useful temperature in the one-step process is determined primarily by the decomposition point of the components in the reaction mixture including the reactants and the desired products. The decomposition point is that temperature at which there is sufficient decomposition of any reactant or product such as to interfere with the production of the desired products.

In the one-step process, the molar ratio of maleic reactant to chlorine is such that there is at least about one mole of chlorine for each mole of maleic reactant to be incorporated into the product. Moreover, for practical reasons, a slight excess, usually in the neighborhood of about 5% to about 30% by weight of chlorine, is utilized in order to offset any loss of chlorine from the reaction mixture. Larger amounts of excess chlorine may be used but do not appear to produce any beneficial results.

As mentioned previously, in one embodiment the molar ratio of polyalkene to maleic reactant is such that there are at least about 1.3 moles of maleic reactant for each mole of polyalkene. This is necessary in order that there can be at least 1.3 succinic groups per equivalent weight of substituent group in the product. Preferably, however, an excess of maleic reactant is used. Thus, ordinarily about a 5% to about 25% excess of maleic reactant will be used relative to that amount necessary to provide the desired number of succinic groups in the product.

The terminology "substituted succinic acylating agent(s)" is used herein in describing the substituted succinic acylating agents regardless of the process by which they are produced. Obviously, as discussed in more detail hereinbefore, several processes are available for producing the substituted succinic acylating agents. On the other hand, the terminology "substituted acylating composition(s)" may be used to describe the reaction mixtures produced by the specific preferred processes described in detail herein. Thus, the identity of particular substituted acylating compositions is dependent upon a particular process of manufacture. This is particularly true because, while the products of this invention are clearly substituted succinic acylating agents as defined and discussed above, their structure cannot be represented by a single specific chemical formula. In fact, mixtures of products are inherently present. For purposes of brevity, the terminology "acylating reagent(s)" is often used hereafter to refer, collectively, to both the substituted succinic acylating agents and to the substituted acylating compositions used in this invention.

The carboxylic esters (B-1) are generally those which are reaction products of the above-described succinic acylating agents with hydroxy compounds $[R_1(OH)_m]$ (B-1-b) as defined earlier with respect to Formula VII which may be aliphatic compounds such as monohydric and polyhydric alcohols or aromatic hydroxy compounds such as phenols and naphthols.

Aromatic hydroxy compounds include phenols (which are preferred), carbon-, oxygen-, sulfur- and nitrogen-bridged phenols and the like as well as phenols directly linked through covalent bonds (e.g., 4,4'-bis(-hydroxy)biphenyl, hydroxy compounds derived from fused-ring hydrocarbon (e.g., naphthols and the like); and polyhydroxy compounds such as catechol, resorcinol and hydroquinone. Mixtures of one or more aromatic hydroxy compounds can be used as the first reagent.

These aromatic hydroxy compounds are preferably substituted with at least-one, and preferably not more than two, aliphatic or alicyclic substituents having at least about 6 (usually at least about 20 carbon atoms and up to about 100 or so) carbon atoms. Examples of such substituents derived from the polymerization of olefins such as ethylene, propylene, 1-butene, 2-butene, isobutene and the like. Both homopolymers (made from a single olefin monomer) and interpolymers (made from two or more of olefin monomers) can serve as sources of these substituents and are encompassed in the term "polymers" as used herein. Substituents derived from polymers of ethylene, propylene, 1-butene and isobutene are preferred, especially those containing at least about 20 carbon atoms.

Introduction of the aliphatic or alicyclic substituent onto the phenol or other aromatic hydroxy compound is usually effected by mixing a hydrocarbon (or a halogenated derivative thereof, or the like) and the phenol at a temperature of about 50°–200° C. in the presence of a suitable catalyst, such as aluminum trichloride, boron trifluoride, zinc chloride or the like. See, for example, U.S. Pat. No. 3,368,972 which is incorporated by reference for its disclosures in this regard. This substituent can also be introduced by other alkylation processes known in the art.

The aromatic hydroxy compounds from which the esters may be derived are illustrated by the following specific examples: phenol, beta-naphthol, alpha-naphthol, cresol, resorcinol, catechol, p,p'-dihydroxybiphenyl, 2-chlorophenol, 2,4-dibutylphenol, etc.

The alcohols from which the esters may be derived preferably contain up to about 40 aliphatic carbon atoms. They may be monohydric alcohols such as methanol, ethanol, isooctanol, dodecanol, cyclohexanol, cyclopentanol, behenyl alcohol, hexatriacontanol, neopentyl alcohol, isobutyl alcohol, benzyl alcohol, beta-phenylethyl alcohol, 2-methylcyclohexanol, beta-chloroethanol, monomethyl ether of ethylene glycol, monobutyl ether of ethylene glycol, monopropyl ether of diethylene glycol, monododecyl ether of triethylene glycol, mono-oleate of ethylene glycol, monostearate of diethylene glycol, sec-pentyl alcohol, tert-butyl alcohol, 5-bromo-dodecanol, nitrooctadecanol and dioleate of glycerol. The polyhydric alcohols preferably contain from 2 to about 10 hydroxy groups. They are illustrated by, for example, ethylene glycol, diethylene glycol, triethylene glycol, tetraethylene glycol, propylene glycol, dipropylene glycol, tripropylene glycol, butylene glycol, dibutylene glycol, tributylene glycol, other alkylene glycols in which the alkylene group contains from 2 to about 8 carbon atoms and mixtures thereof. Other useful polyhydric alcohols include glycerol, monooleate of glycerol, monostearate of glycerol, monomethyl ether of glycerol, trimethylol propane (TMP) , pentaerythritol, 9,10-dihydroxystearic acid, 1,2-butanediol, 1,4-butanediol, 2,3-hexanediol, 2,4-hexanediol, pinacol, erythritol, arabitol, sorbitol, mannitol, 1,2-cyclo-hexanediol, 1,4-butanediol, 2,3-hexanediol, pinacol, erythritol, arabitol, sorbitol, mannitol, 1,2-cyclohexanediol, 1,4-cyclohexanediol, 1,4-(2-hydroxyethyl)cyclohexane, 1,4-dihydroxy-2-nitro-butane, 1,4-di(2-hydroxyethyl) benzene, xylylene glycol or a mixture of two or more thereof.

Carbohydrates such as sugars, starches, celluloses, and so forth, likewise can be used as the polyhydric alcohol (B-1-b) . Specific examples are glucose, raffinose, mannose, glyceraldehyde, galactose, or a mixture of two or more thereof.

The esters (B-1) may also be derived from unsaturated alcohols such as allyl alcohol, cinnamyl alcohol, propargyl alcohol, 1-cyclohexen-3-ol, and oleyl alcohol.

Still other classes of the alcohols capable of yielding the esters of this invention comprises the ether-alcohols and amino-alcohols including, for example, the oxy-alkylene-, oxy-arylene-, amino-alkylene-, and amino-arylene-substituted alcohols having one or more oxy-alkylene, oxy-arylene, amino-alkylene or amino-arylene groups. They are exemplified by Cellosolve, Carbitol, phenoxy-ethanol, mono(heptyl-phenyl-oxypropylene)-substituted glycerol, poly(styrene oxide), aminoethanol, 3-amino ethylpentanol, di(2-hydroxyethyl) amine, p-aminophenol, tris(hydroxymethyl) aminomethane, tri(3-hydroxypropyl) amine, N-hydroxyethyl ethylene diamine, di(2-hydroxyethyl)amine, tri(3-hydroxypropyl)amine, N,N'-di(hydroxyethyl) ethylenediamine, N,N-di-(2-hydroxyethyl)glycine and esters of N,N-di-(2-hydroxyethyl)glycine with lower mono- and polyhydric aliphatic alcohols, N,N,N',N'-tetrahydroxytrimethylene diamine, and the like. For the most part, the ether-alcohols having up to about 50 oxy-alkylene groups in which the alkylene group contains from 1 to about 4 carbon atoms and tris(hydroxymethyl-)aminomethane are preferred.

Copolymers, such as a copolymer of allyl alcohol and styrene, are also included within the scope of the polyhydric alcohols (B-1-b).

Among the above preferred polyhydric alcohols, aliphatic polyhydric alcohols containing up to about 10 carbon atoms are preferred, and those containing at least 3 carbon atoms are more preferred. Examples are glycerol, erythritol, pentaerythritol, gluconic acid, glyceraldehyde, glucose, arabinose, 1,7-heptanediol, 2,4-heptanediol, trimethylolpropane, 1,2,3-hexanetriol, 1,2,4-hexanetriol, 1,2,5-hexanetriol, 2,3,4-hexanetriol, 1,2,3-butanetriol, 1,2,4-butanetriol, quinic acid, 2,2,6,6-tetrakis-(hydroxymethyl)-cyclohexanol, 1,10-decanediol, digitalose and mixtures of two or more thereof.

Particularly preferred are those polyhydric alcohols having at least 3 hydroxyl groups and up to about 10 carbon atoms, and polyhydric alcohols containing from about 3 to about 6 carbon atoms are also particularly preferred. Examples of particularly preferred polyhydric alcohols are glycerol, erythritol, pentaerythritol, mannitol, sorbitol, 1,2,4-hexanetriol and mixtures of two or more thereof, among which pentaerythritol is most preferred.

The above-mentioned polyhydric alcohols (B-1-b) are well known and commercially available.

The esters may be diesters of succinic acids or acidic esters, i.e., partially esterified succinic acids; as well as partially esterified polyhydric alcohols or phenols, i.e., esters having free alcoholic or phenolic hydroxyl groups. Mixtures of the above-illustrated esters likewise are contemplated within the scope of this invention.

A suitable class of esters for use in this invention are those diesters of succinic acid and an alcohol having up to about 9 aliphatic carbon atoms and having at least one substituent selected from the class consisting of amino and carboxy groups wherein the hydrocarbon substituent of the succinic acid is generally a polymerized butene substituent having a number average molecular weight within a general or preferred range set forth above for the "hydrocarbyl substituents" of the desired ashless dispersants of the present invention.

The mono- or polycarboxylic acid or anhydride (B-1-a) is reacted with the polyhydric alcohol (B-1-b) according to conventional esterification techniques. This normally involves heating the acid or anhydride with the alcohol, optionally in the presence of a normally liquid, substantially inert, organic liquid solvent/diluent and/or in the presence of an esterification catalyst. Temperatures of about 100° C. up to the decomposition point of either the reactants or products produced by the reaction may be used. This temperature is usually within the range from about 100° C. up to about 300° C. with temperatures of about 140° C. to 250° C. often being employed.

In most cases the carboxylic esters are a mixture of esters, the precise chemical composition and the relative proportions of which in the product are difficult to determine. Consequently, the product of such reaction is best described in terms of the process by which it is formed.

It is preferred to use less than one equivalent of acid or anhydride (B-1-a) for each equivalent of alcohol reagent (B-1-b) in the above esterification, and usually the ratio is at least about one-half equivalent of acid or anhydride per equivalent of alcohol. An equivalent of the acid or anhydride may be calculated from the number of carboxylic functions present in the acid or anhydride. In determining the number of equivalents of acid or anhydride, those carboxyl functions which are not capable of reacting as a carboxylic acid are excluded. When the carboxylic acid or anhydride is a succinic acid or anhydride, in general there are two equivalents of acid or anhydride for each succinic group in the acid or anhydride. Conventional techniques are readily available for determining the number of carboxyl functions (e.g., acid number, saponification number) and, thus, determining the number of equivalents of acid or anhydride reagent available to react with the polyhydric alcohol.

An equivalent of alcohol is its molecular weight divided by the total number of hydroxyl groups present in the molecule. Thus, an equivalent weight of ethanol is its molecular weight while the equivalent weight of ethylene glycol is one-half its molecular weight.

Many issued patents disclose procedures for reacting high molecular weight carboxylic acids or anhydrides with alcohols to produce acidic esters and neutral esters. These same techniques are applicable to preparing esters from the acids or anhydrides and the alcohols described above.

In some instances it is advantageous to carry out the esterification in the presence of a catalyst such as sulfuric acid, pyridine hydrochloride, hydrochloric acid, benzene sulfonic acid, p-toluene sulfonic acid, phosphoric acid, or any other known esterification catalyst. The amount of the catalyst in the reaction may be as little as 0.01% (by weight of the reaction mixture), more often from about 0.1% to about 5%.

In one embodiment, the esters (B-1) may be obtained by the reaction of a substituted succinic acid or anhydride with an epoxide or a mixture of an epoxide and water. Such reaction is similar to one involving the acid or anhydride with a glycol. For instance, the ester may be prepared by the reaction of a substituted succinic acid with one mole of ethylene oxide. Similarly, the ester may be obtained by the reaction of a substituted succinic acid with two moles of ethylene oxide. Other epoxides which are commonly available for use in such reaction include, for example, propylene oxide, styrene oxide, 1,2-butylene oxide, 2,3-butylene oxide, epichlorohydrin, cyclohexene oxide, 1,2-octylene oxide, epoxidized soybean oil, methyl ester of 9,10-epoxy- stearic acid, and butadiene mono-epoxide. For the most part, the epoxides are the alkylene oxides in which the alkylene group has from 2 to about 8 carbon atoms; or the epoxidized fatty acid esters in which the fatty acid group has up to about 30 carbon atoms and the ester group is derived from a lower alcohol having up to about 8 carbon atoms.

In lieu of the succinic acid or anhydride, a substituted succinic acid halide may be used in the processes illustrated above for preparing the esters. Such acid halides may be acid dibromides, acid dichlorides, acid monochlorides, and acid monobromides. The substituted succinic anhydrides and acids can be prepared by, for example, the reaction of maleic anhydride with a high molecular weight olefin or a halogenated hydrocarbon such as is obtained by the chlorination of an olefin polymer described previously. The reaction involves merely heating the reactants at a temperature preferably from about 100° C. to about 250° C. The product from such a reaction is an alkenyl succinic anhydride. The alkenyl group may be hydrogenated to an alkyl group. The anhydride may be hydrolyzed by treatment with water or steam to the corresponding acid. Another method useful for preparing the succinic acids or anhydrides involves the reaction of itaconic acid or anhydride with an olefin or a chlorinated hydrocarbon at a temperature usually within the range from about 100° C. to about 250° C. The succinic acid halides can be prepared by the reaction of the acids or their anhydrides with a halogenation agent such as phosphorus tribromide, phosphorus pentachloride, or thionyl chloride. These and other methods of preparing the carboxylic esters (A-2-b) are well known in the art and need not be illustrated in further detail here. For example, see U.S. Pat. No. 3,522,179 which is hereby incorporated by reference for its disclosure of the preparation of carboxylic ester compositions useful as component (B-1).

Esters in which the carboxylic acid and/or anhydride is at least about 90 percent esterified (i.e., at least about 90 percent of the carboxyl groups of the carboxylic acid and/or anhydride have formed ester linkages with the polyhydric alcohol reagent) are preferred.

Preferably, the esters contain unesterified hydroxyl groups from the polyhydric alcohol. In a preferred embodiment, at least about 30 percent of the hydroxyl groups of the polyhydric alcohol reagent are unesterified. In a more preferred embodiment, at least about 45 percent are unesterified. The inventor believes that the unesterified hydroxyl groups contribute to compatibility with the alcohol fuel due to their polarity in the ester molecules. However, the inventor does not wish to be bound by this theory in defining the scope of his invention.

The following examples illustrate the esters (B-1) and the processes for preparing such esters.

EXAMPLE E-1

A substantially hydrocarbon-substituted succinic anhydride is prepared by chlorinating a polyisobutene having a number average molecular weight of 1000 to a chlorine content of 4.5% and then heating the chlorinated polyisobutene with 1.2 molar proportions of maleic anhydride at a temperature of 150°–220° C. A mixture of 874 grams (1 mole) of the succinic anhydride and 104 grams (1 mole) of neopentyl glycol is maintained at 240°–250° C./30 mm for 12 hours. The residue is a mixture of the esters resulting from the esterification of one and both hydroxy groups of the glycol.

EXAMPLE E-2

The dimethyl ester of the substantially hydrocarbon-substituted succinic anhydride of Example E-1 is prepared by heating a mixture of 2185 grams of the anhydride, 480 grams of methanol, and 1000 cc of toluene at 50°–65° C. while hydrogen chloride is bubbled through the reaction mixture for 3 hours. The mixture is then heated at 60°–65° C. for 2 hours, dissolved in benzene, washed with water, dried and filtered. The filtrate is heated at 150° C./60 mm to remove volatile components. The residue is the desired dimethyl ester.

EXAMPLE E-3

The substantially hydrocarbon-substituted succinic anhydride of Example E-1 is partially esterified with an ether-alcohol as follows. A mixture of 550 grams (0.63 mole) of the anhydride and 190 grams (0.32 mole) of a commercial polyethylene glycol having a molecular weight of 600 is heated at 240°–250° C. for 8 hours at atmospheric pressure and 12 hours at a pressure of 30 mm. Hg until the acid number of the reaction mixture is reduced to about 28. The residue is the desired acidic ester.

EXAMPLE E-4

A mixture of 926 grams of a polyisobutene-substituted succinic anhydride having an acid number of 121, 1023 grams of mineral oil, and 124 grams (2 moles per mole of the anhydride) of ethylene glycol is heated at 50°–170° C. while hydrogen chloride is bubbled through the reaction mixture for 1.5 hours. The mixture is then heated to 250° C./30 mm and the residue is purified by washing with aqueous sodium hydroxide followed by washing with water, then dried and filtered. The filtrate is a 50% oil solution of the desired ester.

EXAMPLE E-5

A mixture of 645 grams of the substantially hydrocarbon-substituted succinic anhydride prepared as is described in Example E-1 and 44 grams of tetramethylene glycol is heated at 100°–130° C. for 2 hours. To this mixture there is added 51 grams of acetic anhydride (esterification catalyst) and the resulting mixture is heated under reflux at 130°–160° C. for 2.5 hours. Thereafter the volatile components of the mixture are distilled by heating the mixture to 196°–270° C./30 mm and then at 240° C./0.15 mm for 10 hours. The residue is the desired acidic ester.

EXAMPLE E-6

A dioleyl ester is prepared as follows: a mixture of 1 mole of a polyisobutene-substituted succinic anhydride prepared as in Example E-1, 2 moles of a commercial oleyl alcohol, 305 grams of xylene, and 5 grams of p-toluene sulfonic acid (esterification catalyst) is heated at 150°–173° C. for 4 hours whereupon 18 grams of water is collected as the distillate. The residue is washed with water and the organic layer dried and filtered. The filtrate is heated to 175° C./20 mm and the residue is the desired ester.

EXAMPLE E-7

A mixture of about 872 grams of mineral oil and 1000 grams of the substituted succinic anhydride prepared as in Example E-1 is heated to about 150°–160° C., and 109 grams of monopentaerythritol are added while maintaining the reaction temperature below about 176° C. The mixture then is heated to about 205° C. and maintained at this temperature for at least 8 hours. The mixture is blown with oxygen for an additional 8 hours at about 205° C. as some water is removed. The mixture is blended with additional oil, if desired, and filtered. The filtrate is an oil solution of the desired ester (45% oil).

The carboxylic esters which are described above resulting from the reaction of an acylating agent with a hydroxy-containing compound such as an alcohol or a phenol (B-1) may be further reacted with an amine (B-2), and particularly polyamines.

In one embodiment, the amount of amine (B-2) which is reacted with the ester is an amount such that there is at least about 0.01 equivalent of the amine for each equivalent of acylating agent initially employed in the reaction with the alcohol. Where the acylating agent has been reacted with the alcohol in an amount such that there is at least one equivalent of alcohol for each equivalent of acylating agent, this small amount of amine is sufficient to react with minor amounts of non-esterified carboxyl groups which may be present. In one preferred embodiment, the amine-modified carboxylic acid esters utilized as component (B) are prepared by reacting about 1.0 to 2.0 equivalents, preferably about 1.0 to 1.8 equivalents of hydroxy compound, and up to about 0.3 equivalent, preferably about 0.02 to about 0.25 equivalent of polyamine per equivalent of acylating agent.

Acylated nitrogen compositions produced from the acylating reagents (B-1-a) and the amines (B-2) comprise acylated amines which include amine salts, amides, imides, etc., as well as mixtures thereof, which are useful as ashless dispersants of (B). The acylating reagent and the amine are reacted in amounts sufficient to provide from about one-half equivalent up to about 2 moles of amine per equivalent of acylating reagent. U.S. Pat. Nos. 3,172,892; 3,219,666; 3,272,746; and 4,234,435 are expressly incorporated herein by reference for their disclosures with respect to the procedures applicable to reacting the acylating reagents with the amines as described above.

In another embodiment, the carboxylic acid acylating agent (B-1-a) may be reacted simultaneously with both the alcohol (B-1-b) and the amine (B-2). There is generally at least about 0.01 equivalent of the alcohol and at least 0.01 equivalent of the amine although the total amount of equivalents of the combination should be at least about 0.5 equivalent per equivalent of acylating agent.

The amino compound (B-2) is characterized by the presence within its structure of at least one HN< group and it can be a monoamine or polyamine compound. Mixtures of two or more amino compounds can be used in the reaction. Preferably, the amino compound contains at least one primary amino group (i.e., $—NH_2$) and more preferably the amine is a polyamine, especially a polyamine containing at least two —NH— groups, either or both of which are primary or secondary amines. The amines may be aliphatic, cycloaliphatic, aromatic, or heterocyclic amines including aliphatic-substituted cycloaliphatic, aliphatic-substituted aromatic, aliphatic-substituted heterocyclic, cycloaliphatic-substituted aliphatic, cycloaliphatic-substituted heterocyclic, aromatic-substituted aliphatic, aromatic-substituted cycloaliphatic, aromatic-substituted heterocyclic, heterocyclic-substituted aliphatic, heterocyclic-substituted alicyclic, and heterocyclic-substituted aromatic amines and may be saturated or unsaturated. The amines may also contain non-hydrocarbon substituents or groups as long as these groups do not significantly interfere with the reaction of the amines with the acylating reagents of this invention. Such non-hydrocarbon substituents or groups include lower alkoxy, lower alkyl mercapto, nitro, interrupting groups such as —O— and —S—(e.g., as in such groups as $—CH_2—$, $CH_2—X—CH_2CH_2—$ where X is —O— or —S—).

The amines ordinarily contain less than about 40 carbon atoms in total and usually not more than about 20 carbon atoms in total.

Aliphatic monoamines include mono-aliphatic and di-aliphatic substituted amines wherein the aliphatic groups can be saturated or unsaturated and straight or branched chain. Thus, they are primary or secondary aliphatic amines. Such amines include, for example, mono- and di-alkyl-substituted amines, mono- and di-alkenyl-substituted amines, and amines having one N-alkenyl substituent and one N-alkyl substituent and the like. The total number of carbon atoms in these aliphatic monoamines will, as mentioned before, normally not exceed about 40 and usually not exceed about 20 carbon atoms. Specific examples of such monoamines include ethylamine, diethylamine, n-butylamine, di-n-butylamine, allylamine, isobutylamine, cocoamine, stearylamine, laurylamine, methyllaurylamine, oleylamine, N-methyl-octylamine, dodecylamine, octadecylamine, and the like.

Aromatic amines include those monoamines wherein a carbon atom of the aromatic ring structure is attached directly to the amino nitrogen. The aromatic ring will usually be a mononuclear aromatic ring (i.e., one derived from benzene) but can include fused aromatic rings, especially those derived from naphthalene. Examples of aromatic monoamines include aniline, di(-paramethylphenyl) amine, naphthylamine, N-(n-butyl) aniline, and the like. Examples of aliphatic-substituted, cycloaliphatic-substituted, and heterocyclic-substituted aromatic monoamines are para-ethoxyaniline, para-dodecylaniline, cyclohexyl-substituted naphthylamine, and thienyl-substituted aniline.

Polyamines are aliphatic, cycloaliphatic and aromatic polyamines analogous to the above-described monoamines except for the presence within their structure of additional amino nitrogens. The additional amino nitrogens can be primary, secondary or tertiary amino nitrogens. Examples of such polyamines include N-aminopropyl-cyclohexylamines, N,N'-di-n-butyl-paraphenylene diamine, bis-(para-aminophenyl)methane, 1,4-diaminocyclohexane, and the like.

Heterocyclic mono- and polyamines can also be used in making the carboxylic derivative compositions (B). As used herein, the terminology "heterocyclic mono- and polyamine(s)" is intended to describe those heterocyclic amines containing at least one primary or secondary amino group and at least one nitrogen as a heteroatom in the heterocyclic ring. However, as long as there is present in the heterocyclic mono- and polyamines at least one primary or secondary amino group, the hetero-N atom in the ring can be a tertiary amino nitrogen; that is, one that does not have hydrogen attached directly to the ring nitrogen. Heterocyclic amines can be saturated or unsaturated and can contain various substituents such as nitro, alkoxy, alkyl mercapto, alkyl, alkenyl, aryl, alkaryl, or aralkyl substituents. Generally, the total number of carbon atoms in the substituents will not exceed about 20. Heterocyclic amines can contain hetero atoms other than nitrogen, especially oxygen and sulfur. Obviously they can contain more than one nitrogen hetero atom. The five- and six-membered heterocyclic rings are preferred.

Hydroxy-substituted mono- and polyamines, analogous to the mono- and polyamines described above are also useful in preparing carboxylic derivatives of (B)

provided they contain at least one primary or secondary amino group. Hydroxy-substituted amines having only tertiary amino nitrogen such as in tri-hydroxyethyl amine, are thus excluded as amine reactants. The hydroxy-substituted amines contemplated are those having hydroxy substituents bonded directly to a carbon atom other than a carbonyl carbon atom; that is, they have hydroxy groups capable of functioning as alcohols. Examples of such hydroxy-substituted amines include ethanolamine, di-(3-hydroxypropyl)-amine, tris(hydroxymethyl)aminomethane, 3-hydroxybutylamine, 4-hydroxybutylamine, diethanolamine, di-(2-hydroxypropyl)-amine, N-(hydroxypropyl)propylamine, N-(2-hydroxyethyl)-cyclohexylamine, 3-hydroxycyclopentylamine, parahydroxyaniline, N-hydroxyethyl piperazine, and the like.

Hydrazine and substituted-hydrazine can also be used. At least one of the nitrogens in the hydrazine must contain a hydrogen directly bonded thereto. Preferably there are at least two hydrogens bonded directly to hydrazine nitrogen and, more preferably, both hydrogens are on the same nitrogen. The substituents which may be present on the hydrazine include alkyl, alkenyl, aryl, aralkyl, alkaryl, and the like. Usually, the substituents are alkyl, especially lower alkyl, phenyl, and substituted phenyl such as lower alkoxy substituted phenyl or lower alkyl substituted phenyl. Specific examples of substituted hydrazines are methylhydrazine, N,N-dimethyl-hydrazine, N,N'-dimethylhydrazine, phenylhydrazine and N-phenyl-N'-ethylhydrazine.

Another group of amines suitable for post-treating are branched polyalkylene polyamines. The branched polyalkylene polyamines are polyalkylene polyamines wherein the branched group is a side chain containing on the average at least one nitrogen-bonded aminoalkylene group per nine amino units present on the main chain, for example, 1–4 of such branched chains per nine units on the main chain, but preferably one side chain unit per nine main chain units. Thus, these polyamines contain at least three primary amino groups and at least one tertiary amino group.

Useful branched polyalkylene polyamines include Polyamine N-400 TM.

U.S. Pat. Nos. 3,200,106 and 3,259,578 are expressly incorporated herein by reference for their disclosure of how to make such polyamines and processes for reacting them with carboxylic acid acylating agents. Those acylating processes can be used to prepare the carboxylic acid esters of the present invention.

Suitable amines also include polyoxyalkylene polyamines, e.g., polyoxyalkylene diamines and polyoxyalkylene triamines, having number average molecular weights ranging from about 200 to 1,000 and preferably from about 200 to about 400.

The preferred polyoxyalkylene polyamines for purposes of this invention include the polyoxyethylene and polyoxypropylene diamines and the polyoxypropylene triamines having average molecular weights ranging from about 200 to 400. The polyoxyalkylene polyamines are commercially available and may be obtained, for example, from the Jefferson Chemical Company, Inc. under the trade name "Jeffamines D-230, D-400, T-403 TM," etc.

U.S. Pat. Nos. 3,804,763 and 3,948,800 are expressly incorporated herein by reference for their disclosure of such polyoxyalkylene polyamines and process for acylating them with carboxylic acid acylating agents, which processes can be applied to their reaction with the carboxylic acid esters of the present invention.

The most preferred amines for post-treating are the alkylene polyamines, including the polyalkylene polyamines, as described in more detail hereafter. The alkylene polyamines include those conforming to the formula $$H-\underset{\underset{R^9}{|}}{N}\left(\text{Alkylene}-\underset{\underset{R^{10}}{|}}{N}\right)_k R^{11} \qquad \text{(XIII)}$$

wherein k is a number in the range from 1 to about 10, each of $R^9$, $R^{10}$ and $R^{11}$ independently is a hydrogen atom, a hydrocarbyl group or a hydroxy-substituted hydrocarbyl group having up to about 30 atoms, and the "Alkylene" group has from about 1 to about 10 carbon atoms, but the preferred alkylene is ethylene or propylene. Especially preferred are the alkylene polyamines wherein each of $R^9$, $R^{10}$ and $R^{11}$ independently is hydrogen, and the ethylene polyamines and mixtures of ethylene polyamines are most preferred. Usually k will have an average value of from about 2 to about 7. Such alkylene polyamines include methylene polyamine, ethylene polyamines, butylene polyamines, propylene polyamines, pentylene polyamines, hexylene polyamines, heptylene polyamines, etc. The higher homologs of such amines and related aminoalkyl-substituted piperazines are also included.

Alkylene polyamines useful in preparing the post-treated carboxylic acid esters include ethylene diamine, triethylene tetramine, propylene diamine, trimethylene diamine, hexamethylene diamine, decamethylene diamine, octamethylene diamine, di(heptamethylene)triamine, tripropylene tetramine, tetraethylene pentamine, pentaethylene hexamine, di(trimethylene)triamine, N-(2-aminoethyl)piperazine, 1,4-bis(2-aminoethyl) piperazine, and the like. Higher homologs obtained by condensing two or more of the above-illustrated alkylene amines are useful for post-treating as are mixtures of two or more of any of the afore-described polyamines.

Ethylene polyamines, such as those mentioned above, are especially useful for reasons of cost and effectiveness. Such polyamines are described in detail under the heading "Diamines and Higher Amines" in *The Encyclopedia of Chemical Technology*, Second Edition, Kirk-Othmer, Volume 7, pages 27–39, Interscience Publishers, Division of John Wiley and Sons, 1965, which is hereby incorporated by reference for their disclosure of useful polyamines. Such compounds are prepared most conveniently by the reaction of an alkylene chloride with ammonia or by reaction of an ethylene imine with a ring-opening reagent such as ammonia, etc. These reactions result in the production of the somewhat complex mixtures of alkylene polyamines, including cyclic condensation products such as piperazines. On the other hand, quite satisfactory post-treated products can also be obtained by the use of pure alkylene polyamines.

Other useful types of polyamine mixtures are those resulting from stripping of the above-described polyamine mixtures. In this instance, lower molecular weight polyamines and volatile contaminants are removed from an alkylene polyamine mixture to leave as residue what is often termed "polyamine bottoms". In general, alkylene polyamine bottoms can be characterized as having less than two, usually less than 1% (by weight) material boiling below about 200° C. In the instance of ethylene polyamine bottoms, which are readily available and found to be quite useful, the bottoms contain less than about 2% (by weight) total diethylene triamine (DETA) or triethylene tetramine (TETA). A typical sample of such ethylene polyamine bottoms obtained from the Dow Chemical Company of Freeport, Tex. designated "E-100 TM" has a specific gravity at 15.6° C. of 1.0168, a percent nitrogen by weight of 33.15 and a viscosity at 40° C. of 121 centistokes. Gas chromatography analysis of such a sample shows it to contain about 0.93% "Light Ends" (most probably DETA), 0.72% TETA, 21.74% tetraethylene pentamine and 76.61% pentaethylene hexamine and higher (by weight). These alkylene polyamine bottoms include cyclic condensation products such as piperazine and higher analogs of diethylene triamine, triethylene tetramine and the like.

Hydroxyalkyl alkylene polyamines having one or more hydroxyalkyl substituents on the nitrogen atoms are also useful in preparing amide or ester functional derivatives of the afore-described olefinic carboxylic acids. Preferred hydroxyalkyl-substituted alkylene polyamines are those in which the hydroxyalkyl group is a lower hydroxyalkyl group, i.e., having less than eight carbon atoms. Examples of such hydroxyalkyl-substituted polyamines include N-(2-hydroxyethyl) ethylene diamine, N,N-bis (2-hydroxyethyl)ethylene diamine, 1-(2-hydroxyethyl)piperazine, monohydroxypropyl-substituted diethylene triamine, dihydroxypropyl-substituted tetraethylene pentamine, N-(3-hydroxybutyl)tetramethylene diamine, etc. Higher homologs such as obtained by condensation of the above-illustrated hydroxy alkylene polyamines through amino radicals or through hydroxy radicals are likewise useful as post-treated reagents. Condensation through amino radicals accompanied by removal of ammonia and condensation through the hydroxy radicals results in higher amine products containing ether linkages accompanied by removal of water.

Another type of condensation reaction producing useful products is a condensation reaction between at least one hydroxy compound with at least one polyamine reactant containing at least one primary or secondary amino group. The hydroxy compounds may be selected from among the hydroxy compounds ($R_1(OH)_m$) (Formula VII of (B-1-b)) as defined above, including hydroxy-substituted oxyalkylenes and hydroxy-substituted thioalkylenes, and hydroxy-substituted mono- and polyamines. The polyamines may be selected from among any of the amines suitable for post-treating described above or the "polyamine bottoms" also described above.

In a preferred embodiment, polyamines useful in the present invention are derived from polyhydroxy alkylene polyamines and polyalkylene polyamines. These preferred reactants are illustrated by Formula (XIV):

$$(R)_{n+1}Y(X)_q(AOH)_m \qquad \text{(XIV)}$$

wherein R represents hydrogen or a hydrocarbyl group, Y represents nitrogen, oxygen, or sulfur, X represents an alkylene group, A represents a hydrocarbylene group, m represents a number in the range from 1 to 3, q represents a number having a value of 0 or 1, and n represents a number having a value which, when added to the number 1, satisfies the valence of Y and a polyamine reactant represented by Formula (XV):

$$H-\underset{\underset{R}{|}}{N}(Z-NR')_xR. \qquad \text{(XV)}$$

wherein R is defined in the same way as defined above in Formula (XIV), R' represents a hydrogen atom, an alkyl group or $NH_2R''(NR'')_y$ wherein y represents a number in the range from 1 to about 6 and R'' represents an alkylene group having from 1 to about 10 carbon atoms, Z represents an alkylene group having from 1 to about 10 carbon atoms, an oxyalkylene group having from 1 to about 10 carbon atoms, or a nitrogen-containing heterocyclic ring having from 1 to about 10 carbon atoms and x represents a number having a value from 1 to about 10. Preferably X and A of Formula (XIV) combined comprise 2 carbon atoms.

In a preferred embodiment, Y represents a nitrogen atom, m is 2 or 3, n is 1 and q is 1 in Formula (XIV). The preferred polyamines derived from these preferred compounds of Formula (XIV) in which m is 3 comprise units which may be represented by Formula (XVI) below:

(XVI)

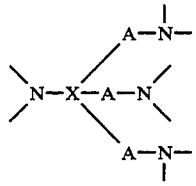

wherein X and A are the same as defined in Formula (XIV) above. Even more preferably X and A of Formula XVI represent a carbon atom and methylene groups, respectively. Such more preferred compounds may be derived from tris (hydroxymethyl) aminomethane (THAM).

Preferred amine reactants include triethylenetetramine (TETA), tetraethylenepentamine (TEPA), pentaethylenehexamine (PEHA), and mixtures of polyamines such as the above-described "amine bottoms".

The reaction of the amine reactant (B-2) with the hydroxy group-containing reactant (B-1-b) is conducted at an elevated temperature in the presence of an acid catalyst. Those catalysts useful for this purpose include mineral acids (mono, di- and poly basic acids) such as sulfuric acid and phosphoric acid; organo phosphorus acids and organo sulfonic acids such as $R^*P(O)(OH)_2$ and $R^*SO_3H$, wherein R* is hydrocarbyl; alkali metal partial salts of $H_3PO_4$ and $H_2SO_4$, such as $NaHSO_4$, $LiHSO_4$, $KHSO_4$, $NaH_2PO_4$, $LiH_2PO_4$ and $KH_2PO_4$; alkaline earth metal partial salts of $H_3PO_4$ and $H_2SO_4$, such as $CaHPO_4$, $CaSO_4$ and $MgHPO_4$; also $Al_2O_3$ and zeolites. Phosphoric acid is preferred because of its commercial availability and ease of handling. Also useful as catalysts are materials which generate acids when treated in the reaction mixture, e.g., triphenylphosphite. The elevated temperature depends upon the particular reactants. It can range from 60° C. to about 265° C. Most reactions, however, are run in the 220° C. to about 250° C. range. The reaction may be run at atmospheric pressure or optionally at a reduced pressure depending upon the particular reactants and the concomitant economics.

Control over the degree of condensation of the product of the present invention is normally accomplished by limiting the amount of the hydroxy group-containing reactant charged to the reaction medium. In a preferred embodiment, the condensed polyamines for use in the present invention are pourable at room temperature and have viscosities which preferably range from about 100% to about 3000%, more preferably from about 1000% to about 1800%, greater than the viscosity of the amine reactant of Formula (XIV). In one embodiment, the viscosity of the condensed polyamines falls in the range from about 50 cSt to about 200 cSt, preferably from about 80 to about 150 cSt, at 100° C.

The preparation of such polyamine condensates is illustrated in the following examples.

EXAMPLE PA-1

A 4-necked 500-ml round-bottomed flask equipped with glass stirrer, thermowell, subsurface $N_2$ inlet, Dean-Stark trap, and Friedrich condenser is charged with a) 201 grams of tetraethylenepentamine (TEPA), b) 151 grams of 40% aqueous tris(hydroxymethyl-)aminomethane (THAM), and c) 3.5 grams of 85% $H_3PO_4$.

This mixture is heated to 120° C. over 1.0 hour. With $N_2$ sweeping, the mixture is then heated to 130° C. over 1 hour, then to 230° C. over 2 hours more, then held at 230°–240° C. for 4 hours, and then held at 241°–250° C. for 3 hours. The product is cooled to 150° C. and filtered with diatomaceous earth filter aid.

EXAMPLE PA-2

A 4-necked 3-liter round-bottomed flask equipped with glass stirrer, thermowell, subsurface $N_2$inlet, Dean-Stark trap, and Friedrich condenser is charged with:

a) 1299 grams of HPA Taft Amines (amine bottoms), and b) 727 grams of 40% aqueous tris (hydroxymethyl) aminomethane (THAM) .

This mixture is heated to 60° C. and 23 grams of 85% $H_3PO_4$ is added. The mixture is then heated to 120° C. over 0.6 hour. With $N_2$ sweeping, the mixture is then heated to 150° C. over 1.25 hour, then to 235° C. over 1 hour more, then held at 230°–235° C. for 5 hours, then heated to 240° C. over 0.75 hour, and then held at 240°–245° C. for 5 hours. The product is cooled to 150° C. and filtered with a diatomaceous earth filter aid. Yield: 84% (1221 grams).

EXAMPLE PA-3

A 3-liter flask equipped with stirrer, thermowell, below surface $N_2$ inlet and a stripping condenser is charged with 363 grams of THAM and 1200 grams of TEPA. Next, 16 grams of $H_3PO_4$ is added while heating the mixture to 110° C. $N_2$ blowing at 0.25 cfh is commenced. The mixture is then heated to 220° C. in 0.8 hour and held at 220°–225° C. for 1.2 hours; then heated to 230° C. in 0.2 hour and held at 230° C. for 4.75 hours: 129 g distillate is collected. The remaining mixture is held at 242°–245° C. for 5 hours: 39 g of additional distillate is collected in trap. The remaining mixture is held at 246°–255° C. for 1.2 hours: a total of 178 g of material is collected in trap. The mixture is then filtered at 155° C. using 45 g of a diatomaceous earth filter aid.

EXAMPLE PA-4

A 3-liter flask equipped with stirrer, thermowell, below surface $N_2$ inlet and a stripping condenser was charged with 363 grams of THAM and 1200 grams of TEPA. 16 grams of $H_3PO_4$ was added at 100° C. $N_2$ blowing was commenced at 0.2 cfh. The mixture was heated to 165° C. in 0.4 hour; and to 241° C. in 0.6 hour. Held at 241°–243° C. for 0.3 hour. The contents were further heated to 250° C. for an additional 0.5 hour and held at 250° C. for 5.5 hour: 288 g of material was collected in the trap. This material was filtered at 150° C. using 55 g of diatomaceous earth filter aid.

The above-described condensed polyamines may be used as is to provide some dispersancy. However, these amines are preferably reacted with at least one of the above-described carboxylic acylating agents (B-1-a) or esters thereof (B-1) to produce acylated amines which are highly effective as dispersants.

The carboxylic acylating agents (B-1-a) and the corresponding carboxylic acid esters thereof (B-1) described hereinbefore treated with the above-described amines produce acylated amines which include amine salts, amides, imides and imidazolines as well as mixtures thereof. To prepare acylated amines from the amines (B-2) and the carboxylic acylating agents (B-1-a) and esters (B-1), one or more carboxylic acylating agents (B-1-a) and/or esters (B-1) and one or more amines (B-2) are heated, optionally in the presence of a normally liquid, substantially inert, organic liquid solvent/diluent, at temperatures in the range of about 80° C. up to the decomposition point (where the decomposition point is as previously defined), but normally at temperatures in the range of about 100° C. up to about 300° C., provided 300° C. does not exceed the decomposition point. Temperatures of about 125° C. to about 250° C. are often used. The amine (B-2) and the carboxylic acid acylating agents (B-1-a) and esters (B-1) are reacted in amounts sufficient to provide from about one-half equivalent to about 2 moles of amine per equivalent of carboxylic acylating agent. For purposes of this invention an equivalent of amine is that amount of the amine corresponding to the total weight of amine divided by the total number of nitrogens present. Thus, octylamine has an equivalent weight equal to its molecular weight; ethylene diamine has an equivalent weight equal to one-half its molecular weight; and aminoethylpiperazine has an equivalent weight equal to one-third its molecular weight.

Because the carboxylic acid ester (B-1) can be used in the same manner as the high molecular weight acylating agents of the prior art in preparing acylated amines suitable as additives for lubricating oil compositions, U.S. Pat. Nos. 3,172,892; 3,219,666; and 3,272,746 are expressly incorporated herein by reference for their disclosure with respect to the procedures applicable to reacting the carboxylic acid esters of this invention with the amines as described above as well as reacting acylating agents which are not esters with the amines. In applying the disclosures of these patents to the carboxylic acid esters (B-1), the latter can be substituted for the carboxylic acid acylating agents disclosed in these patents on an equivalent basis. That is, where one equivalent of the carboxylic acylating agent disclosed in these incorporated patents is utilized, one equivalent of the esters of this invention can be used. These patents are also incorporated by reference for their disclosure of how to use the acylated amines thus produced as additives in lubricating oil compositions. Dispersant/detergent properties can be imparted to lubricating oils by incorporating the acylated amines produced by reacting the esters of this invention with the amines described above.

Typical dispersants may be represented by the Formula:

$$Q_qJ_j \quad \text{(XVII)}$$

wherein Q represents the carboxylic acylating agent, J represents the polyamine, q represents a number having a value of at least 1, and j represents a number having a value of at least 1. Preferably the number of equivalents of Q equals the number of equivalents of J. Preferably, the total base number of the dispersant of Formula XVII is in the range from about 3 to about 90, more preferably in the range from about 20 to about 70, and even more preferably in the range from about 40 to about 60.

These dispersants generally have a low free amine content. The expression "low free amine content" may be defined as a free amine content of less than about 0.1 weight-percent free amines (i.e., non-acylated amines). Preferably, these dispersants contain substantially no free amine.

The above-described hydrocarbyl-substituted succinic acids, anhydrides or esters are preferred carboxylic acylating agents. The hydrocarbyl substituent is preferably a polyalkylene group having a Mn value and a Mw/Mn value within the respective ranges specified above for the preferred carboxylic acylating agents.

The following examples illustrate acylated amine dispersants prepared from the above-described condensed polyamines reacted with the above-described acylating agents.

EXAMPLE AA-1

A 4-necked 12 liter round-bottomed flask equipped with stirrer, thermowell, subsurface $N_2$ inlet, Dean-Stark trap and Friedrich condenser is charged with (a) 460 g. polyamine prepared according to Example PA-1 above, with $H_3PO_4$ present as an acid catalyst and (b) 2500 g. 2 C. mineral oil. The mixture is heated to 105° C. and 3360 g. of a poly(isobutylene) (Mn=1000)-substituted succinic anhydride having a saponification number of 100 is added through a funnel over 1.5 hours. Nitrogen gas blowing is commenced slowly. The mixture is heated to 160° C. and held for 5.0 hours. The mixture is filtered at 150° C. with diatomaceous earth filter aid to give the final product. Yield: 96% (5991 g), 40% 2 C. mineral oil. Analysis: % N=2.31/3=2.42; Free Amine=Nil; TBN=49.1.

EXAMPLE AA-2

A 4-necked 12 liter round-bottomed flask equipped with stirrer, thermowell, subsurface $N_2$ inlet, Dean-Stark trap and Friedrich condenser is charged with (a) 605 grams polyamine prepared according to Example PA-2 above, $H_3PO_4$ as catalyst and (b) 3262 grams mineral oil. The mixture is heated to 110° C. and 4300 grams of a poly(isobutylene) (Mn=1000)-substituted succinic anhydride having a saponification number of 100 is added through a funnel over 0.7 hour. Nitrogen gas blowing is commenced slowly. The mixture is heated to 160° C. over 1 hour and held at 160°-162° C. for 5 hours.

The mixture is filtered at 150° C. with diatomaceous earth filter aid to give the final product. Yield: 96% (8155 g), 40% mineral oil. Analysis: % N=2.28/2.19; TBN=46.5; TAN=7.7.

EXAMPLE AA-3

A 1-liter flask equipped with stirrer, thermowell and reflux condenser is charged with 39 g of the reaction product of Example PA-4 and 75 g MeOH. This mixture is heated and stirred until a clear solution is obtained at 40° C. To the mixture mineral oil is added at 40° C. A solution of 218 g of a poly(isobutylene) (Mn=1000)-substituted succinic anhydride having a saponification number of 100 in 110 g MePh is added over 0.8 hour at 50°-62° C. This mixture is held at 50°-65° C. for 1 hour and is then stripped to 110° C. in 1.5 hours; then to 120° C. in 1 hour; and then to 160° C. in 0.8 hour. Nitrogen gas blowing is commenced slowly at 0.15 cfh and held at 160° C. for 6.0 hours and then filtered at 150° C. using 25 g of diatomaceous earth filter aid.

EXAMPLE AA-4

To a 1-liter flask equipped with stirrer, thermowell, below surface $N_2$ inlet and Dean-Stark trap is charged 64.6 g of the product of Example PA-1 and 168 grams of a diluent oil. To this mixture is added 110 g of a poly(propylene) (Mn=168)-substituted succinic anhydride having a saponification number of 420 over 0.1 hour at 110° C.-135° C. Nitrogen gas blowing is held at 130° C. for 0.2 hour and then heated to 165° C. over 0.8 hour and held at 165° C. for 4.5 hours. The mixture is filtered at 145° C. using 25 g of diatomaceous earth filter aid.

The following specific examples illustrate the preparation of the esters wherein both alcohols and amines are reacted with the acylating agent.

EXAMPLE AA-5

A mixture of 334 parts (0.52 equivalent) of the polyisobutene-substituted succinic acylating agent prepared in Example E-2, 548 parts of mineral oil, 30 parts (0.88 equivalent) of pentaerythritol and 8.6 parts (0.0057 equivalent) of Polyglycol 112-2 demulsifier from Dow Chemical Company is heated at 150° C. for 2.5 hours. The reaction mixture is heated to 210° C. in 5 hours and held at 210° C. for 3.2 hours. The reaction mixture is cooled to 190° C. and 8.5 parts (0.2 equivalent) of a commercial mixture of ethylene polyamines having an average of about 3 to about 10 nitrogen atoms per molecule are added. The reaction mixture is stripped by heating at 205° C. with nitrogen blowing for 3 hours, then filtered to yield the filtrate as an oil solution of the desired product.

EXAMPLE AA-6

A mixture of 322 parts (0.5 equivalent) of the polyisobutene-substituted succinic acylating agent prepared in Example E-2, 68 parts (2.0 equivalents) of pentaerythritol and 508 parts of mineral oil is heated at 204°-227° C. for 5 hours. The reaction mixture is cooled to 162° C. and 5.3 parts (0.13 equivalent) of a commercial ethylene polyamine mixture having an average of about 3 to 10 nitrogen atoms per molecule is added. The reaction mixture is heated at 162°-163° C. for one hour, then cooled to 130° C. and filtered. The filtrate is an oil solution of the desired product.

EXAMPLE AA-7

The procedure for Example AA-6 is repeated except the 5.3 parts (0.13 equivalent) of ethylene polyamine is replaced by 21 parts (0.175 equivalent) of tris(hydroxymethyl)aminomethane.

EXAMPLE AA-8

A mixture of 1480 parts of the polyisobutene-substituted succinic acylating agent prepared in Example E-5, 115 parts (0.53 equivalent) of a commercial mixture of $C_{12-18}$ straight-chain primary alcohols, 87 parts (0.594 equivalent) of a commercial mixture of $C_{8-10}$ straight-chain primary alcohols, 1098 parts of mineral oil and 400 parts of toluene is heated to 120° C. At 120° C., 1.5 parts of sulfuric acid are added and the reaction mixture is heated to 160° C. and held for 3 hours. To the reaction mixture are then added 158 parts (2.0 equivalents) of n-butanol and 1.5 parts of sulfuric acid. The reaction mixture is heated at 160° C. for 15 hours, and 12.6 parts (0.088 equivalent) of aminopropyl morpholine are added. The reaction mixture is held at 160° C. for an additional 6 hours, stripped at 150° C. under vacuum and filtered to yield an oil solution of the desired product.

EXAMPLE AA-9

(A) A mixture of 1000 parts of polyisobutene having a number average molecular weight of about 1000 and 108 parts (1.1 moles) of maleic anhydride is heated to about 190° C. and 100 parts (1.43 moles) of chlorine are added beneath the surface over a period of about 4 hours while maintaining the temperature at about 185°–190° C. The mixture then is blown with nitrogen at this temperature for several hours, and the residue is the desired polyisobutene-substituted succinic acylating agent.

(B) A solution of 1000 parts of the above-prepared acylating agent in 857 parts of mineral oil is heated to about 150° C. with stirring, and 109 parts (3.2 equivalents) of pentaerythritol are added with stirring. The mixture is blown with nitrogen and heated to about 200° C. over a period of about 14 hours to form an oil solution of the desired carboxylic ester intermediate. To the intermediate, there are added 19.25 parts (0.46 equivalent) of a commercial mixture of ethylene polyamines having an average of about 3 to about 10 nitrogen atoms per molecule. The reaction mixture is stripped by heating at 205° C. with nitrogen blowing for 3 hours and filtered. The filtrate is an oil solution (45% oil) of the desired amine-modified carboxylic ester which contains 0.35% nitrogen.

The above-described carboxylic esters, amines, acylated amines, and Mannich dispersants are effective ashless dispersants in the present invention. In another embodiment, these compositions may be considered as intermediates and post-treated with one or more post-treating reagents selected from the group consisting of boron trioxide, boron anhydrides, boron halides, boron acids, boron amides, esters of boric acids, carbon disulfide, hydrogen sulfide, sulfur, sulfur chlorides, alkenyl cyanides, carboxylic acid acylating agents, aldehydes, ketones, urea, thiourea, guanidine, dicyanodiamide, hydrocarbyl phosphates, hydrocarbyl phosphites, hydrocarbyl thiophosphates, hydrocarbyl thiophosphites, phosphorus sulfides, phosphorus oxides, phosphoric acid, hydrocarbyl thiocyanates, hydrocarbyl isocyanates, hydrocarbyl isothiocyanates, epoxides, episulfides, formaldehyde or formaldehyde-producing compounds with phenols, and sulfur with phenols. These post-treating reagents can be used with carboxylic derivative compositions prepared from the acylating reagents and a combination of amines and alcohols as described above.

Since processes involving the use of these post-treating reagents are known insofar as application to reaction products of carboxylic acid acylating agents and amines and/or alcohols, a detailed description of these processes herein is believed unnecessary. The following U.S. Patents are expressly incorporated herein by reference for their disclosure of post-treating processes and post-treating reagents applicable to the carboxylic derivative compositions of this invention: U.S. Pat. Nos. 3,087,936; 3,254,025; 3,256,185; 3,278,550; 3,282,955; 3,284,410; 3,338,832; 3,533,945; 3,639,242; 3,708,522; 3,859,318; 3,865,813; etc. U.K. Patent Nos. 1,085,903 and 1,162,436 also describe such processes.

Preferred Amounts of Components

Preferred amounts of (A) are those which when formulated as a lubricant composition are sufficient to contribute about 0.05 to about 0.25 weight percent magnesium, barium, or a mixture thereof to the lubricant composition of the present invention.

It is desirable to include component (B) in the lubricant formulation of the present invention in that the lubricant can then be considered to be a multi-purpose lubricant for use in either conventional fuel or alcohol-powered internal combustion engines, since component (B) can function as a dispersant for the high concentration of undesirable lubricant contaminants resulting from the use of conventional fuels. Component (B) may be optional in the above formulation when the lubricant formulation is utilized solely in alcohol-powered internal combustion engines which generally do not produce the high concentration of conventional fuel-type contaminants. However, the presence of component (B) may nevertheless be desirable in that it may function in a new role with alcohol fuels. The new role includes suspending aqueous contamination and helping to reduce corrosion by preventing the migration of aqueous contamination to metallic surfaces susceptible to corrosion.

Preferably, component (B) is present in the formulated lubricant composition in an amount of at least about 0.5, and preferably up to about 3 weight-percent, and more preferably up to about 2 weight-percent (B).

A significant aspect of the present invention is that the lubricant composition contains not more than 0.06 weight-percent calcium. Reducing the amount of calcium present to that level helps prevent the undesired internal deposits and the injector tip fouling which have been problematic with alcohol-powered internal combustion engines lubricated with conventional crankcase lubricants. Preferably, the final formulation of the lubricant composition contains not more than about 0.03 weight-percent calcium.

Some metal salts of component (A) above contain calcium as a contaminant. Magnesium sulfonates, for example, sometimes contain 2 or 3 weight-percent calcium relative to the total magnesium and calcium present when, for example, they are made from magnesium oxide. Detergents made directly from the metal generally are not contaminated with calcium. The presence of calcium in other components should also be taken into consideration in order to assure that the desired amounts of calcium are attained in the final formulation.

The inventor has found that it may also be desirable to limit the presence of sodium in the lubricant formulation due to the tendency of the presence of sodium to increase rust and corrosion in the alcohol-powered internal combustion engine environment. Preferably, the amount of sodium is not greater than 0.06 weight-percent, more preferably it is not more than 0.03 weight-percent, even more preferably not more than 0.01 weight-percent, and most preferably there is substantially no sodium present.

The inventor has also found that the amount of zinc present may be limited to not more than 0.20 weight-percent zinc in the lubricating oil formulation. In some cases, the amount of zinc in the formulation may be not more than 0.12 weight-percent, and may even be as low as 0.06 weight-percent or less.

As mentioned above, the inventor has found that it is desirable to limit the presence of hydrocarbyl-substituted ashless dispersants in which a hydrocarbyl substituent has a number average molecular weight greater than about 1500. Generally, it is desired that not more than about 0.5 weight-percent of such ashless dispersants be present. Preferably, not more than about 0.2 weight-percent, and more preferably not more than about 0.1 weight-percent is present. Within these general and preferred limits, it is preferred that the hydrocarbyl substituents have a number average molecular weight not greater than about 1100.

In one embodiment, the total amount of acylated amine dispersant may be limited to not more than about 1.5 weight-percent of the lubricant formulation.

In addition, the inventor has found that it is generally desirable to limit the amount of polymeric viscosity improvers in the formulation. In one embodiment, the lubricant formulations of the present invention contain not more than 0.5 weight-percent olefin polymer and copolymer viscosity improvers such as polybutene; ethylene-propylene copolymers; copolymers of ethylene and other low molecular weight olefins; terpolymers of ethylene, propylene, and various dienes; polybutadiene; etc. In another embodiment, the lubricant formulations of the present invention contain not more than 0.5 weight-percent styrene-diene copolymer viscosity improvers such as styrene-butadiene copolymers. In yet another embodiment, the lubricant formulations of the present invention contain not more than 0.5 weight-percent polymethacrylate viscosity improvers. The lubricant formulations of the present invention may be limited to a polymeric viscosity improver concentration of not more than about 0.5 weight-percent, more preferably less than about 0.3 weight-percent, and even more preferably not more than about 0.2 weight-percent with regard to the individual types of polymeric viscosity improvers mentioned above or polymeric viscosity improvers in general, including other polymeric viscosity improvers such as polyacrylate, styrene ester, alkylated polystyrene, and alkylene polyether viscosity improvers.

Polymeric viscosity improver-dispersants are components which perform a dual function as viscosity improvers and as dispersants. As such, they generally fall under provisos limiting ashless dispersants and provisos limiting the presence of polymeric viscosity improvers. Typical polymeric viscosity improver-dispersants include copolymers of alkyl methacrylates with N-vinyl pyrrolidone or dimethylaminoalkyl methacrylate, alkyl fumerate vinyl acetate N-vinyl pyrollidine copolymers, post-grafted interpolymers of ethylenepropylene with an active monomer such as maleic anhydride which may be further reacted with an alcohol or an alkylene polyamine, e.g. see U.S. Pat. Nos. 4,089,794, 4,160,739, 4,137,185; or copolymers of ethylene and propylene reacted or grafted with nitrogen compounds such as shown in U.S. Pat. Nos. 4,068,056 4,068,058, 4,146,489, 4,149,984; styrene/maleic anhydride polymer post-reacted with alcohols and amines, ethoxylated derivatives of acrylate polymers, for example, see U.S. Pat. No. 3,702,300.

(C) Oil of Lubricating Viscosity

Component (C) includes a wide variety of oils of lubricating viscosity, including natural and synthetic lubricating oils and mixtures thereof. Natural oils include animal oils and vegetable oils (e.g., castor oil, lard oil) as well as solvent-refined or acid-refined mineral lubricating oils of the paraffinic, naphthenic, or mixed paraffin-naphthenic types. Oils of lubricating viscosity derived from coal or shale are also useful base oils. Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, etc.); alkyl benzenes (e.g., dodecylbenzenes, tetradecylbenzenes, dinonylbenzenes, di-(2-ethylhexyl) benzenes, etc.); polyphenyls (e.g., biphenyls, terphenyls, alkylated polyphenyls, etc.); and the like.

Alkylene oxide polymers and interpolymers and derivatives thereof where the terminal hydroxyl groups have been modified by esterification, etherification, etc., constitute another class of known synthetic lubricating oils that can be used. These are exemplified by the oils prepared through polymerization of ethylene oxide or propylene oxide, the alkyl and aryl ethers of these polyoxyalkylene polymers or mono- and polycarboxylic esters thereof.

Another suitable class of synthetic lubricating oils that can be used comprises the esters of dicarboxylic acids (e.g. , phthalic acid, succinic acid, alkyl succinic acid, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, pentaerythritol, etc.). Specific examples of these esters include dibutyl adipate, di(2-ethylhexyl)-sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethyl-hexanoic acid, and the like.

Esters useful as synthetic oils also include those made from $C_5$ to $C_{12}$ monocarboxylic acids and polyols and polyol ethers such as neopentyl glycol, trimethylol propane, pentaerythritol, dipentaerythritol, tripentaerythritol, etc.

Silicon-based oils such as the polyalkyl-, polyaryl-, polyalkoxy-, or polyaryloxy-siloxane oils and silicate oils comprise another class of useful oils. These include tetraethyl-silicate, tetraisopropylsilicate, tetra-(2-ethylhexyl)-silicate, tetra-(4-methylhexyl)-silicate, tetra(p-tert-butylphenyl)-silicate, hexyl-(4-methyl-2-pentoxy)-di-siloxane, poly(methyl)siloxanes, poly-(methylphenyl)-siloxanes, etc. Other useful synthetic oils include liquid esters of phosphorus-containing acid (e.g., tricresyl phosphate, trioctyl phosphate, diethyl ester of decane phosphonic acid, etc.), polymeric tetrahydrofurans, and the like.

The above-described synthetic oils are preferred when a multigrade lubricant formulation is desired within the polymeric viscosity index improver limitations described above. Many synthetic oils inherently provide the viscosity index required for multigrade oils. Of those synthetic oils mentioned above, examples of types of synthetic oils which provide the inherent multigrade properties include polyalphaolefin hydrocarbon oils, esters of dicarboxylic acids, and esters made from $C_5$ to $C_{12}$ monocarboxylic acids and polyols and polyolethers such as those derived from trimethylolpropane and pentaerythritol.

Unrefined, refined and rerefined oils (and mixtures of each with each other) of the type disclosed hereinabove can be used in the lubricant and functional fluid compositions of the present invention. Unrefined oils are those obtained directly from a natural or synthetic source without further purification treatment. For example, a shale oil obtained directly from a retorting operation, a petroleum oil obtained directly from distillation or ester oil obtained directly from an esterification process and used without further treatment would be an unrefined oil. Refined oils are similar to the unrefined oils except that they have been further treated in one or more purification steps to improve one or more properties. Many such purification techniques are known to those of skill in the art such as solvent extraction, distillation, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed toward removal of spent additives and oil breakdown products.

These lubricants and functional fluids include crankcase lubricating oils for spark-ignited and compression-ignited internal combustion engines, including automobile, bus and truck engines, aviation four-cycle piston engines, marine and railroad diesel engines, and the like. They can also be used in gas engines, stationary power engines and turbines and the like. Transmission fluids (including both automatic transmission fluids and manual transmission fluids), transaxle lubricants, gear lubricants, metal-working lubricants, hydraulic fluids and other lubricating oil and grease compositions can also benefit from the incorporation therein of the compositions of the present invention.

The above-described lubricating oils may further contain functional additives to achieve improved performance under various applications. Typical functional additives for use in the present invention include corrosion inhibitors, surfactants, detergents, valve train protectors, extreme pressure agents, oxidation inhibitors, foam inhibitors, and pour point depressants. A discussion of the functional additives which may typically be used with the present invention follows.

(D) Carboxylic Acid or Anhydride

It is often advantageous to incorporate a minor amount of at least one carboxylic acid or anhydride, a partial ester of a polycarboxylic acid or anhydride, or a metal or amine salt of such acids, anhydrides or partial esters, into the lubricant compositions of the present invention. These compounds generally provide improved corrosion resistance. Suitable mono- and polycarboxylic acids, anhydrides and partial esters, and metal and amine salts of such acids, anhydrides, and partial esters are well known in the art and include those described in detail above in relation to "carboxylic acids" useful in making the salts (A) of the present invention under the sub-heading "Carboxylic Acids".

In a preferred embodiment, (D) comprises succinic acids, anhydrides, and partial esters, and metal and amine salts thereof. Useful hydrocarbyl-substituted succinic acids and anhydrides are represented by formulae (IA) and (IB) described above in connection with the carboxylic acids useful for preparing the salts of (A). The number average molecular weight of the hydrocarbyl substituents of (D) is preferably at least about 150, and more preferably at least about 250, and is generally not greater than about 1,500. In one embodiment, their number average molecular weight is not more than about 1,100. In another embodiment, their number average molecular weight is not more than about 800. Advantages in using these preferred acids and anhydrides, partial esters thereof, and metal and amine salts of these acids, anhydrides and partial esters, include greater compatibility with the alcohol fuel at the fuel-lubricant interface and greater rust and corrosion inhibition.

In one embodiment, component (D) comprises a partial ester of the above-described polycarboxylic acids and anhydrides. The partial esters of (D) are formed by reacting carboxylic acids and/or anhydrides with an alcohol such that less than 100 percent of the carboxyl groups have reacted with the available hydroxy groups.

It is preferred to use less than one equivalent of alcohol for each equivalent of acid or anhydride reagent in the above esterification. In one embodiment, an average of from zero to about 70 percent of the carboxyl groups of the polycarboxylic acids and anhydrides are esterified (i.e., the partial ester contains at least about 30 percent unesterified carboxyl groups).

The alcohol used to make (D) preferably contains up to about 20 aliphatic carbon atoms and from 2 to about 10 hydroxyl groups. More preferably, the alcohol is a diol.

Alkylene and polyalkylene glycols wherein each alkylene moiety contains from 2 to about 8 carbon atoms, such as ethylene glycol, propylene glycol, trimethylene glycol, butylene glycol and mixtures of two or more thereof, are examples of alkylene glycols which may be used. Examples of polyalkylene glycols are diethylene glycol, triethylene glycol, tetraethylene glycol, dipropylene glycol, tripropylene glycol, dibutylene glycol, tributylene glycol and mixtures of two or more thereof.

Component (D) of this invention is preferably oil-soluble, although oil-solubility is not a required feature. Component (D) may, for example, be dispersed, rather than dissolved or solubilized, in a lubricant formulation or concentrate additive. The carboxylic acids, anhydrides, partial esters, and metal and amine salts thereof, of (D) may be present in amounts up to about 1.0 weight-percent, but preferably are present in an amount in the range from about 0.2 to about 0.4 weight-percent, which generally corresponds to about 3 to about 7 weight-percent in the concentrate, provided that the proviso limiting the presence of calcium and any optional proviso limiting the presence of sodium or zinc are complied with.

(E) Surfactant

Surfactants often are useful as functional additives in that they have been known to provide corrosion inhibition. Typically, the surfactant is a hydrophilic surfactant and generally it has an HLB (hydro-philic-lipophilic balance) in the range from about 10 to about 20.

The surfactant can be of the cationic, anionic, non-ionic or amphoteric type. Many such surfactants of each type are known to the art. See, for example, McCutcheon's "Detergents and Emulsifiers", 1978, North American Edition, published by McCutcheon's Division, MC Publishing Corporation, Glen Rock, N.J. U.S.A., particularly pages 17–33 which are hereby incorporated by reference for their disclosures in this regard.

Of these surfactants, non-ionic surfactants are generally used. A number of non-ionic surfactant types are known. Among these are the alkylene oxide-treated products, such as ethylene oxide-treated phenols, alcohols, esters, amines and amides. Ethylene oxide/propylene oxide block copolymers are also useful nonionic surfactants. Glycerol esters and sugar esters are also known to be non-ionic surfactants. A typical nonionic surfactant class useful with the derivatives of the present invention are the alkylene oxide-treated alkyl phenols such as the ethylene oxide alkyl phenol condensates sold by the Rohm & Haas Company. A specific example of these is Triton X-100 TM which contains an average of 9–10 ethylene oxide units per molecule, has an HLB value of about 13.5 and a molecular weight of about 628. Another example is Surfonic N-40 TM, which comprises nonylphenoxypoly (ethyleneoxy) ethanol and is commercially available from Texaco. Many other suitable non-ionic surfactants are known. See, for example, the afore-mentioned McCutcheon's, as well as the treatise "Non-ionic Surfactants" edited by Martin J. Schick, M. Drekker Co., New York, 1967, which is hereby incorporated by reference for its disclosure in this regard.

Anionic surfactants contain negatively charged polar groups while cationic surfactants contain positively charged polar groups. Amphoteric dispersants contain both types of polar groups in the same molecule. A general survey of useful surfactants is found in Kirk Othmer *Encyclopedia of Chemical Technology*, Second Edition, Volume 19, page 507 and following (1969, John Wiley and Son, New York) and the aforementioned compilation published under the name of McCutcheon's. These references are both hereby incorporated by reference for their disclosures relating to cationic, amphoteric and anionic surfactants.

Among the useful anionic surfactant types are the widely known metal carboxylate soaps, organo sulfates, sulfonates, sulfocarboxylic acids and their salts, and phosphates. Useful cationic surfactants include nitrogen compounds such as amine oxides and the well known quaternary ammonium salts. Amphoteric surfactants include amino acid type materials and similar types. Various cationic, anionic and amphoteric dispersants are available from the industry, particularly from such companies as Rohm and Haas and Union Carbide Corporation. Further information about anionic and cationic surfactants also can be found in the texts "Anionic Surfactants", Parts II and III, edited by W. M. Linfield, published by Marcel Dekker, Inc., N.Y. 1976 and "Cationic Surfactants", edited by E. Jungermann, Marcel Dekker, Inc., N.Y., 1976. Both of these references are incorporated by reference for their disclosures in this regard.

The aforementioned surfactants when employed as corrosion inhibitors are generally employed in amounts up to about 0.3 weight percent, and more preferably in the range from about 0.15 to about 0.25 weight percent. Among the aforementioned surfactants, the polyethoxylated alcohol, polyethoxylated phenol and amine surfactants are preferred. Combinations of such surfactants with the preferred hydrocarbyl-substituted succinic amide and anhydrides of component (D) above are particularly preferred for superior corrosion resistance.

Many commercially available surfactants considered to be useful as demulsifiers can be used in the improved lubricating oil compositions of the present invention for reasons other than demulsification. For example, General Aniline and Film Corporation supplies a line of surface-active agents sold under the name GAFAC TM. Preferred GAFAC TM agents are the alkyl phenoxypoly(ethyleneoxy)ethyl mono- and diesters of phosphoric acid such as GAFAC RE-610 TM and RE-960 TM. Other useful agents are the reaction products of various organic amines, carboxylic acid amides, and quaternary ammonium salts with ethyleneoxide. These polyoxyethylated amines, amides, and quaternary salts are available from Armour Industrial Chemical Co. under the names Ethoduomeen T/20 TM, an ethyleneoxide condensation product of an N-alkyl alkylenediamine produced by Armour under the name Duomeen T TM; Ethomeen TM, tertiary amines which are ethyleneoxide condensation products of primary fatty amines; Ethomid TM, ethyleneoxide condensates of fatty acid amides; and Ethoquad TM, polyoxy ethylated quaternary ammonium salts such as quaternary ammonium chlorides.

Preferred among those listed above are polyoxyalkylene polyols and derivatives thereof. This class of materials are commercially available from various sources: Pluronic Polyols TM from Wyandotte Chemicals Corporation; Polyglycol 112-2 TM, a liquid triol derived from ethyleneoxide and propyleneoxide available from Dow Chemical Co.; and Tergitol TM, dodecylphenol or nonophenol polyethylene glycol ethers, and Ucon TM, polyalkylene glycols and derivatives, both available from Union Carbide Corp. These are but a few of the commercial products suitable as surface active agents in the composition of the present invention.

In addition to the polyols per se, the esters thereof obtained by reacting the polyols with various carboxylic acids are also suitable. Acids useful in preparing these esters are lauric acid, stearic acid, succinic acid, and alkyl- or alkenyl-substituted succinic acids wherein the alkyl- or alkenyl group contains up to about 20 carbon atoms.

The preferred polyols are prepared as block polymers. Thus, a hydroxy-substituted compound, $R(OH)_n$ (where n is 1 to 6, and R is the residue of a mono- or polyhydric alcohol, phenol, naphthol, etc.), is reacted with propylene oxide to form a hydrophobic base. This base is then reacted with ethylene oxide to provide a hydrophilic portion resulting in a molecule having both hydrophobic and hydrophilic portions. The relative sizes of these portions can be adjusted by regulating the ratio of reactants, time of reaction, etc., as is obvious to those skilled in the art. Thus, it is within the skill of the art to prepare polyols whose molecules are characterized by hydrophobic and hydrophilic moieties which are present in a ratio rendering surface active agents suitable for use in any lubricant composition regardless of differences in the base oils and the presence of other additives.

If more oil-solubility is needed in a given lubricating composition, the hydrophobic portion can be increased and/or the hydrophilic portion decreased.

Compounds illustrative of $R(OH)_n$ include alkylene polyols such as the alkylene glycols, alkylene triols, alkylene tetrols, etc., such as ethylene glycol, propylene glycol, glycerol, pentaerylthritol, sorbitol, mannitol, and the like. Aromatic hydroxy compounds such as alkylated mono- and polyhydric phenols and naphthols can also be used, e.g., heptylphenol, dodecylphenol, etc.

Other suitable compounds include the esters disclosed in U.S. Pat. Nos. 3,098,827 and 2,674,619.

The liquid polyols available from Wyandotte Chemicals Co. under the name Pluronic Polyols TM and other similar polyols are particularly well suited. These Pluronic Polyols TM are ethylene-oxide/isopropylene oxide copolymer glycols wherein the ethyleneoxide repeating groups comprise about 10% to about 40% by weight of the total molecular weight of the glycol and the average molecular weight of said glycol is from about 1,000 to about 5,000.

The above-described compounds can be employed in amounts of up to about 5% by weight based upon the weight of the lubricating composition. However, it generally is desirable to add these compounds to the lubricant compositions of the present invention in an amount which is not considered to be a demulsifiably effective amount. The inventor has discovered that some emulsification of water may actually be beneficial in reducing rust and corrosion problems as explained above. Very small amounts are effective. In most instances, concentrations of these compounds in amounts of 0.01 to about 1 weight percent, and usually about 0.02 to about 0.5 weight percent give satisfactory performance. These concentrations generally correspond to from about 0.1 to about 15, and usually about 0.2 to about 8, weight-percent, of the concentrate. Those compounds which have only very limited solubility in the lubricating oil composition to which they are added can be readily employed with satisfactory results due to the small amount required to be present.

(F) Bridged Phenols

Other functional additives which provide anti-rust, anti-sludge and varnish-inhibition, along with anti-corrosion activity are certain bridged phenols. A preferred class of bridged phenols that can be used in the present invention is represented by the general formula (XVIII)

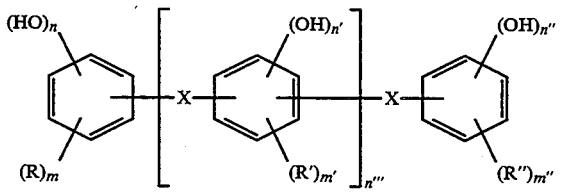

wherein n, n' and n'' are each independently numbers in the range of 1 to about 3 but preferably 1 each; R, R' and R'' are each independently aliphatic hydrocarbon-based groups, generally, alkyl or alkenyl groups, of one to about 300 carbon atoms, preferably about 6 to 200 carbon atoms each, and usually about 30 to 250 carbon atoms each; m, m' and m'' are each independently numbers in the range of 0 to about 3, but generally 1 or 2 each; n''' is a number in the range of 0 to about 20 but usually 0 to about 5; and X is a divalent bridging linkage selected from the group consisting of one or more covalent carbon-to-carbon single bonds, ether linkages, sulfide linkages, polysulfide linkages of two to about six sulfur atoms, sulfinyl linkages, sulfonyl linkages, alkylene linkages, lower alkylene ether linkages, lower alkylene sulfide linkages, lower alkylene polysulfide linkages of two to six sulfur atoms, amino linkages, polyamino linkages and mixtures of said divalent bridging linkages. The divalent bridging linkage more preferably is a lower alkylene linkage of up to seven carbon atoms, and particularly preferably a methylene linkage, $—CH_2—$, or a sulfide or polysulfide radical of the general formula $—S_z—$ where z has an average value of 1 to 6, usually 1 to 4. The bridging linkage can also be a divalent amino-containing radical of the formulae such as

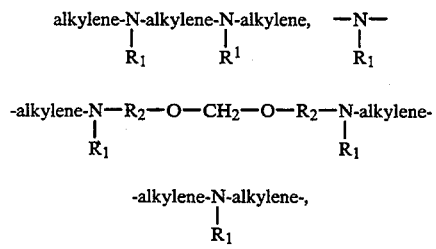

where the alkylene groups are lower alkylene of 1 to about 10 carbons, usually methylene, $R_1$ is hydrogen or lower alkyl group, and $R_2$ is a divalent hydrocarbon group having up to 7 carbon atoms, usually an alkylene group.

These bridged phenols and their neutral and basic metal salts are known and can be prepared by many conventional processes as shown by the following U.S. Patent Nos. which are expressly incorporated herein by reference for their disclosure of the preparation of various bridged phenols and their metal salts:

U.S. Pat. Nos. 2,250,188; 2,280,419; 2,340,036 2,375,222; 2,410,911; 2,415,833; 2,445,736; 2,445,737; 2,459,113; 2,459,114; 2,472,517; 2,472,518; 2,647,873; 2,680,097; 2,711,947; 2,725,358; 2,736,701; 2,786,030; 2,810,697; 2,833,719; 2,920,105; 2,957,908; 3,014,868; 3,057,800; 3,259,551; 3,336,226; 3,338,063; 3,429,812; 3,454,497; 3,474,035; 3,539,633; 3,793,201; 3,873,627.

Among the preferred metal salts of bridged phenols are those selected from the class of neutral metal salts of the condensation products of aliphatic hydrocarbon-substituted phenols and lower aliphatic aldehydes containing up to 7 carbon atoms. The aliphatic hydrocarbon substituents on the phenols used in preparing such condensation products should provide a total of at least 6 aliphatic carbon atoms per molecule of phenol and preferably, a total of at least 8 aliphatic carbon atoms per molecule. Each aliphatic hydrocarbon substituent may contain from about 4 to about 250 or more aliphatic carbon atoms, but generally will contain from about 6 to about 100 aliphatic carbon atoms for use in the present invention. The aliphatic aldehyde used in the formation of these phenol aldehyde condensation products is preferably formaldehyde or a reactive equivalent thereof such as formalin, trioxane or paraformaldehyde. Other suitable aldehydes include acetaldehyde, crotonaldehyde, butyraldehyde, propionaldehyde, and the like. Examples of the preparation of the metal salts of phenol-aldehyde condensation products is found in many of the above-incorporated patents, for example, U.S. Pat. No. 2,647,873.

Methods for making the metal phenoxides from the corresponding phenols are well known to those of skill in the art and need not be dealt with in detail here. For example, phenoxides can be produced by reaction of the pure metal or a hydroxide, oxide or hydride thereof, with the free phenols.

Methods for attaching hydrocarbon-based groups to the aromatic nuclei of bridged phenoxides (or phenol precursors) are equally well known in the art. For example, the production of phenols substituted with aliphatic-based groups is described in the article entitled "Alkylation of Phenols" in Kirk-Othmer *Encyclopedia of Chemical Technology*, Second Edition, Volume 1, pages 894–895, Interscience Publishers a division of John Wiley and Company, 1963, which is hereby incorporated herein by reference. Other equally appropriate and convenient techniques for the production of phenoxides useful in this invention will occur readily to those skilled in the art. The hydrocarbon groups can be introduced either before or after introduction of the bridging linkages between the phenolic nuclei. Preferably, however, they are introduced before.

(G): Extreme Pressure Agents

Extreme pressure (E.P.) agents, which often also function as corrosion-inhibiting agents and anti-oxidants in the lubricants and functional fluids of the invention include sulfurized compounds, such as sulfurized organic compounds, particularly hydrocarbyl sulfides and polysulfides (such as alkyl and aryl sulfides and polysulfides including olefins, aldehydes and esters thereof, e.g., benzyl disulfide, benzyl trisulfide, dibutyltetrasulfide, sulfurized esters of fatty acid, sulfurized alkyl phenols, sulfurized dipentenes and sulfurized terpenes). Among these sulfurized organic compounds, the hydrocarbyl polysulfides are preferred.

The particular species of the sulfurized organic compound is not particularly critical to the present invention. However, it is preferred that the sulfur be incorporated in the organic compound as the sulfide moiety, i.e., in its divalent oxidation state and that it is oil-soluble. The sulfurized organic compound may be prepared by sulfurization of an aliphatic, arylaliphatic or alicyclic hydrocarbon. Olefinic hydrocarbons containing from about 3 to about 30 carbon atoms are preferred for the purposes of the present invention.

U.S. Pat. No. 4,119,549 is incorporated by reference herein for its disclosure of suitable sulfurization products useful as auxiliary extreme pressure/anti-wear agents in the present invention. Several specific sulfurized compositions are described in the working examples thereof.

The functional additive can also be chosen from phosphorus-containing materials and include phosphosulfurized hydrocarbons such as the reaction product of a phosphorus sulfide with terpenes, such as turpentine, or fatty esters, such as methyl oleate, phosphorus esters such as hydrocarbyl phosphites, particularly the acid dihydrocarbyl and trihydrocarbyl phosphites such as dibutyl phosphites, diheptyl phosphite, dicyclohexyl phosphite, pentylphenyl phosphite, dipentylphenyl phosphite, tridecyl phosphite, distearyl phosphite, dimethyl naphthyl phosphite, oleyl 4-pentylphenyl phosphite, polypropylene-substituted phenyl phosphite, diisobutyl-substituted phenyl phosphite; metal salts of acid phosphate and thiophosphate hydrocarbyl esters such as metal phosphorodithioates including zinc dicyclohexyl phosphorodithioate, zinc dioctylphosphorodithioate, barium di(heptylphenol)-phosphorodithioate, cadmium dinonylphosphorodithioate, and the zinc salts of phosphorodithioic acid products such as those produced by reacting phosphorus pentasulfide with a mixture of isopropyl alcohol and n-hexyl alcohol and those produced by reacting phosphorus pentasulfide with a mixture of 4-methyl-pentan- 2-ol and isopropyl alcohol.

Further descriptions of these and other suitable functional additives can be found in the aforementioned treatises "Lubricant Additives" which are hereby incorporated by reference for their disclosures in this regard.

Many of the above-mentioned extreme pressure agents, corrosion inhibitors and antioxidants also serve as antiwear agents. Zinc dialkylphosphorodithioates are a well known example.

Another type of suitable functional additives includes carbamates and their thio analogs such as metal thiocarbamates and dithiocarbamates and their esters, such as zinc dioctyldithiocarbamate, and barium heptylphenyl dithiocarbamate.

Group II metal salts of a phosphorus-containing acid are often generally useful as extreme pressure agents and corrosion- and oxidation-inhibiting agents. Certain dithiophosphate compounds are also known as valve train protectors. The phosphorus-containing acid may be selected from among the phosphorus-containing acids useful in making the salts (A) of the present invention set forth above, namely those represented by Formula (V) above. The Group II metal of these phosphorus-containing functional additives may, for example, be selected from the group consisting of zinc, barium, cadmium or a mixture of two or more of these metals. These compounds may be present in an amount up to about 1 weight percent, preferably up to about 0.5 weight percent, provided that when the Group II metal comprises zinc, a formulation having less than 0.05 weight-percent zinc may be desired in accordance with the present invention.

(H) Other Neutral or Basic Metal Salts

The present invention may also comprise neutral or basic metal salts of at least one acidic organic compound in which the metal in said salt is selected from other than magnesium, barium or a mixture thereof, so long as the provisos restricting the amount of calcium, and optionally restricting the amounts of sodium and zinc, are complied with. The acidic organic compounds may generally be selected from among any of those which are described above under component (A). These components are made according to methods analogous to those described above for making component (A) and are generally known to function as detergents in lubricants.

(I) Hindered Amines

The lubricants of the present invention may further comprise hindered amines which often provide a function of inhibiting oxidation. Hindered amines for use in lubricant formulations are well known in the lubricant field. Preferred hindered amines include diphenol amines, such as monoamines or di-para-alkylated diphenylamines. Amounts up to about 1 weight-percent of the formulation are generally sufficient.

(J) Anti-Foam Agents

Anti-foam agents are used to reduce or prevent the formation of stable foam. Typical anti-foam agents include silicones or organic polymers. Additional anti-foam compositions are described in "Foam Control Agents", by Henry T. Kerner (Noyes Data Corporation, 1976), pages 125–162, which is incorporated herein by reference.

The present invention may contain from about 4 to about 20 parts per million of anti-foam agent, and about 10 parts per million anti-foam agent is preferred.

(K) Pour Point Depressants

Pour point depressants are a particularly useful type of additive often included in the lubricants and functional fluids described herein. The use of such pour point depressants in oil-based compositions to improve low temperature properties of oil-based compositions is well known in the art. See, for example, page 8 of "Lubricant Additives" by C. V. Smallheer and R. Kennedy Smith (Lezius-Hiles Co. publishers, Cleveland, Ohio, 1967), which is incorporated herein by reference.

Examples of useful pour point depressants are polymethacrylates; polyacrylates; polyacrylamides; condensation products of haloparaffin waxes and aromatic compounds; vinyl carboxylate polymers; and terpolymers of dialkylfumarates, vinyl esters of fatty acids and alkyl vinyl ethers. Among these, the polyacrylates, polyacrylamides, vinyl carboxylate polymers, terpolymers of dialkylfumerates, vinyl esters of fatty acids, and alkyl vinyl ethers are preferred. In one embodiment, vinyl carboxylate polymers are particularly preferred.

Pour point depressants useful for the purposes of this invention, techniques for their preparation and their uses are described in U.S. Pat. Nos. 2,387,501; 2,015,748; 2,655,479; 1,815,022; 2,191,498; 2,666,746; 2,721,877; 2,721,878; 3,250,715; and 4,604,221 which are hereby incorporated by reference.

The pour point depressant may be present in the lubricant formulation in amounts up to about 0.5 weight-percent. Preferred pour point depressants are those which have a number average molecular weight in the range of from about 120,000 up to about 150,000 and are preferably those which are not typically considered to also be polymeric VI improvers of the types discussed above, unless they are present as the types and in the amounts permitted under the provisos of the present invention.

Concentrate Formulation

Components of the compositions of this invention can be added directly to the lubricant or functional fluid. Preferably, however, they are diluted with a substantially inert, normally liquid organic diluent (C1) such as mineral oil, naphtha, benzene, toluene and/or xylene, to form an additive concentrate. These concentrates may contain from about 5% to about 99% by weight of combination of components (A) and (B). Usually these concentrates contain from about 30% to about 92% by weight of the combination of components (A) and (B), and may contain, in addition, one or more other additives known in the art or described hereinabove, provided that any calcium, polymeric VI improver, sodium and zinc introduced by the additive concentrate are present in an amount such that when the additive concentrate is diluted to its final concentration as a lubricant, their concentrations do not exceed their respective weight-percent maximums under the provisos of the present invention. The remainder of the concentrate is the substantially inert normally liquid diluent (C1).

One embodiment of a concentrate within the scope of the present invention comprises:

(A) at least one neutral or basic salt of at least one acidic organic compound, the metal in the salt being selected from the group consisting of magnesium, barium and a mixture thereof wherein the metal is present in an amount from about 0.5 to about 2.5 weight-percent;

(B) about 5 to about 50 weight-percent of at least one hydrocarbyl-substituted ashless dispersant in which each hydrocarbyl substituent has a number average molecular weight up to about 1,500; and (C1) a normally liquid solvent/diluent;

provided that the concentrate contains not more than about 0.9 weight-percent calcium and optionally not more than about 8 weight-percent of the above-described polymeric VI improvers. Preferably, the concentrate contains not more than about 0.3 weight-percent calcium, more preferably not more than about 0.2 weight-percent calcium, and not more than about 8 weight-percent total polymeric VI improver. Optionally, it may further be provided that the concentrate contains not more than 1 weight-percent sodium, not more than 3.0 weight-percent zinc, and/or not more than about 7.5 weight-percent pour point depressant (K).

The preferred aspects of the lubricant formulations of the present invention described above apply to the concentrate formulations as well.

In order to illustrate the lubricant compositions of the present invention, examples within the scope of the present invention follow. The weight-percents of overbased materials set forth below are expressed in terms of the amount of metal contributed by the overbased material.

EXAMPLE 1

A. Additive Concentrate Formulation

The following components are combined in the amounts indicated:

| Ingredient | Weight % |
|---|---|
| Magnesium overbased alkyl(Mn = about 500) benzene sulfonate having a metal ratio of 14.7 and a total base number of 400 | 3.7 |
| Magnesium overbased alkyl(Mn = about 500) benzene sulfonate having a metal ratio of 2.8 and a total base number of 100 | 9.9 |
| Polyester of pentaerythritol with polyisobutylene (Mn = about 1000) succinic anhydride | 16.7 |
| Polyisobutylene(Mn = about 1000) succinic anhydride | 4.8 |
| Surfonic N-40 TM from Texaco (Nonylphenoxypoly-(ethyleneoxy)ethanol) | 3.4 |
| Propylene tetramer phenol reacted with sulfur dichloride | 13.0 |
| Zinc phosphorodithioate[1] | 7.1 |
| $C_9$ mono- and di-para-alkylated diphenyl amine | 6.3 |
| Kerosene solution of Dow Corning 200 fluid (1000cSt. at 25° C.) as a foam inhibitor | 0.1 |
| Low viscosity (100 neutral) mineral oil (about 3–4cSt at 100° C.) | 35.0 |

-continued

| Ingredient | Weight % |
|---|---|
| | 100.0 |

[1]The reaction product of a mixture of isopropyl alcohol and 4-methyl-pentan-2-ol with phosphorus pentasulfide, which is then reacted with an oil slurry of zinc oxide containing 10.4% phosphorus, 22.0% sulfur and 11.6% zinc.

A lubricant oil composition may be prepared by adding the concentrate prepared according to (A) above to mineral oil in the desired proportions, as in the example which follows.

B. Lubricant Formulation

| Ingredient | Weight % |
|---|---|
| Additive Concentrate 1(A) set forth above | 6.70 |
| Pour point depressant[2] | 0.31 |
| SAE 30 Base Oil[3] | 92.99 |
| | 100.00 |

[2]A mineral oil solution of a nitrogen-containing mixed ester of a styrene-maleic interpolymer prepared according to "Sample A" in column 12, lines 36–61, of U.S. Pat. No. 4,604,221, which is incorporated herein by reference.
[3]A combination of 75 vol. % 600 neutral mineral oil and 25 vol. % 150 neutral bright.

When the above components are combined, a motor oil suitable for use in internal combustion engines is obtained. This lubricant formulation is found to generally have the following characteristics:

| | |
|---|---|
| Physical characteristics: | |
| Viscosity at 100° C., cSt | 10.89 |
| Viscosity at 40° C., cSt | 93.43 |
| Viscosity index | 101. |
| Cold cranking simulation at −10° C., cP | 3350. |
| Chemical characteristics: | |
| Magnesium, weight % | 0.07 |
| Calcium, weight % | <0.01 |
| Zinc, weight % | 0.05 |
| Phosphorus, weight % | 0.05 |
| Sulfated ash, weight %[4] | 0.41 |
| Total base number | 3.0 |

[4]According to ASTM procedure D874 published by the American Society of Testing Materials, which is incorporated herein by reference.

EXAMPLE 2

A. Additive Concentrate Formulation

The following components are combined in the amounts indicated:

| Ingredient | Weight % |
|---|---|
| Magnesium overbased alkyl(Mn = about 500) benzene sulfonate having a metal ratio of 14.7 and a total base number of 400 | 3.5 |
| Magnesium overbased alkyl(Mn = about 500) benzene sulfonate having a metal ratio of 2.8 and a total base number of 100 | 9.4 |
| Calcium overbased alkyl(Mn = about 500) benzene sulfonate having a metal ratio of 11 and a total base number of 300 | 3.2 |
| Acylated amine product of reaction between polyisobutylene (Mn = about 1000) succinic anhydride with the product of a reaction between tris(hydroxymethyl)aminomethane and polyamine bottoms | 17.2 |
| Polyisobutylene(Mn = about 1000) succinic anhydride | 4.6 |
| Surfonic N-40 TM from Texaco (Nonylphenoxy-poly(ethyleneoxy)ethanol) | 3.3 |
| Propylene tetramer phenol reacted with sulfur dichloride | 12.4 |
| Zinc phosphorodithioate of Example 1(A) | 6.8 |
| $C_9$ mono- and di-para-alkylated diphenyl amine | 4.4 |
| Kerosene solution of Dow Corning 200 fluid (1000cSt. at 25° C.) as a foam inhibitor | 0.1 |
| Low viscosity (100 neutral) mineral oil (about 3–4cSt at 100° C.) | 35.0 |
| | 100.0 |

A lubricant oil composition may be prepared by adding the concentrate prepared according to 2(A) above to mineral oil in the desired proportions, as in the example which follows.

B. Lubricant Formulation

| Ingredient | Weight % |
|---|---|
| Additive Concentrate 2(A) set forth above | 7.00 |
| Pour point depressant of Example 1(B) | 0.31 |
| SAE 30 Base Oil of Example 1(B) | 92.69 |
| | 100.00 |

When the above components are combined, a motor oil suitable for use in internal combustion engines is obtained. This lubricant formulation is found to generally have the following characteristics:

| | |
|---|---|
| Chemical characteristics: | |
| Magnesium, weight % | 0.07 |
| Calcium, weight % | 0.05 |
| Zinc, weight % | 0.05 |
| Phosphorus, weight % | 0.05 |
| Sulfated ash, weight %[5] | 0.58 |
| Total base number | 5.0 |

[5]ASTM procedure D874, Ibid.

EXAMPLE 3

A. Additive Concentrate Formulation

The following components -are combined in the amounts indicated:

| Ingredient | Weight % |
|---|---|
| Magnesium overbased alkyl(Mn = about 500) benzene sulfonate having a metal ratio of 14.7 and a total base number of 400 | 9.5 |
| Magnesium overbased alkyl(Mn = about 500) benzene sulfonate having a metal ratio of 2.8 and a total base number of 100 | 8.4 |
| Calcium overbased alkyl(Mn = about 500) benzene sulfonate having a metal ratio of 11 and a total base number of 300 | 2.7 |
| Acylated amine product of reaction between polyisobutylene (Mn = about 1000) succinic anhydride with the product of a reaction between tris(hydroxymethyl)aminomethane and polyamine bottoms | 15.4 |
| Polyisobutylene(Mn = about 1000) succinic anhydride | 4.1 |
| Surfonic N-40 TM from Texaco (Nonylphenoxy-poly(ethyleneoxy)ethanol) | 2.9 |
| Propylene tetramer phenol reacted with sulfur dichloride | 11.1 |
| Zinc phosphorodithioate of Example 1(A) | 6.1 |
| $C_9$ mono- and di-para-alkylated diphenyl amine | 5.4 |
| Kerosene solution of Dow Corning 200 fluid (1000cSt. at 25° C.) as a foam inhibitor | 0.1 |
| Low viscosity (100 neutral) mineral oil (about | 34.3 |

-continued

| Ingredient | Weight % |
|---|---|
| 3–4cSt at 100° C.) | |
| | 100.0 |

A lubricant oil composition may be prepared by adding the concentrate prepared according to 3(A) above to mineral oil in the desired proportions, as in the example which follows.

B. Lubricant Formulation

| Ingredient | Weight % |
|---|---|
| Additive Concentrate 3(A) set forth above | 7.80 |
| Pour point depressant of Example 1(B) | 0.31 |
| SAE 30 Base Oil of Example 1(B) | 91.89 |
| | 100.00 |

When the above components are combined, a motor oil suitable for use in internal combustion engines is obtained. This lubricant formulation is found to generally have the following characteristics:

| Chemical characteristics: | |
|---|---|
| Magnesium, weight % | 0.14 |
| Calcium, weight % | 0.05 |
| Zinc, weight % | 0.05 |
| Phosphorus, weight % | 0.05 |
| Sulfated ash, weight %[6] | 0.92 |
| Total base number | 8.1 |

[6]ASTM procedure D874, Ibid.

The lubricant formulation of Example 3 is particularly well suited for use as a "universal" crankcase lubricant for either conventional (e.g., gasoline or diesel) fueled or alcohol-powered internal combustion engines.

As mentioned above, the lubricant compositions of the present invention reduce fuel injector fouling. FIG. 1 of the drawings shows a diagram of a cross-sectional view of one type of electronic fuel injector.

In operation, fuel enters the injector through fuel inlet opening 28 and after entering the injector nut 28 cavity, the fuel passes through a drilled passage (not shown) into the poppet control valve 26 and fuel supply chamber 22. The plunger 23 operates up and down in the body bore of the injector body 20 due to the motion of an injector rocker arm (not shown) produced by the action of a cam (not shown), which is transmitted to the plunger 23 via the injector follower 24 which bears against injector follower spring 25. Each stroke of the plunger 23 draws fuel into, and expels fuel from, fuel supply chamber 22.

As the piston in the engine moves approximately two-thirds of the way up in the cylinder on the compression stroke, the injector cam causes the injector rocker arm to push down on injector follower 24 and plunger 23. At that point, the injector solenoid 27 is energized, creating a magnetic force closing poppet control valve 26, which traps fuel under the plunger and passages leading down to the needle valve 36. Fuel pressure increases as plunger 23 continues its downward stroke. This fuel pressure in the lower part of the injector nut assembly acts on both check valve 33 and needle valve 36. When fuel pressure is sufficiently high to overcome the valve spring 34 force holding needle valve 36 on its seat, needle valve 36 moves up, allowing high pressure fuel to spray into the combustion chamber through spray tip 37.

After a predetermined time interval, the solenoid is de-energized, allowing poppet control valve 26 to open, dropping the pressure within the injector. When the pressure is low enough, needle valve 36 closes and ends injection.

During the above process, the entire injector body 20 is immersed in engine lubricant of cylinder head 9. This helps to lubricate and cool moving parts of the fuel injector. Some of this lubricant travels past the moving parts of the fuel injector, namely the injector follower 24 and plunger 23, and comes into contact with fuel in injector body 20 and injector nut 21. Some of this lubricant mixes with fuel passing through the injector and is distributed wherever the fuel is carried. This movement of lubricant into fuel is considered normal in fuel injectors of this type.

This normal fuel-lubricant interface creates a problem when an alcohol fuel, such as methanol, is substituted for diesel fuel when a conventional lubricant is used. A sticky, resinous, deposit is formed near fuel inlet opening 28 impeding free flow of fuel to the remainder of the injector. One aspect of the present invention is the inventor's discovery that these deposits are primarily related to the presence of certain high molecular weight agents in lubricant formulations.

In addition, hard deposits are also found on spray tip 37, distorting the spray pattern. The deposits at spray tip 37 are generally not of the same composition as the resinous deposits near fuel inlet opening 28. A second aspect of the present invention is the inventor's discovery that the spray tip deposits are primarily related to the presence of calcium in metal salt-containing lubricant formulations.

Most types of deposits described above have a substantial effect on engine performance, fuel efficiency, and injector life. Frequent fuel injector replacement is a costly solution.

The present invention generally solves the above problems, by (A) utilizing magnesium and/or barium detergents while reducing the presence of calcium to less than about 0.06 weight-percent in the lubricant formulation, (B) utilizing the ashless dispersants of the present invention having hydrocarbyl substituents within the prescribed Mn value ranges or optionally leaving out the dispersant entirely if the lubricant is used solely in alcohol-powered internal combustion engines and (C) optionally reducing the presence of polymeric viscosity improvers.

(A) and (B) provide the functionality of a detergent and a dispersant, respectively, without the deterioration of engine performance and maintenance problems associated with using conventional engine lubricant additives in alcohol-powered internal combustion engines.

At the same time, rust and corrosion problems associated with alcohol-powered internal combustion engines can be reduced and/or prevented using the lubricant formulations disclosed herein. Finding rust/corrosion inhibition in combination with compatibility with the alcohol fuel environment is surprising in view of the compatibility problems associated with lubricants containing conventional rust and corrosion inhibiting detergent/dispersant additive packages.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A composition comprising:

(A) about 0.05 to about 0.25 weight percent of magnesium present as at least one magnesium salt of at least one organic acid selected from the group consisting of:

(i) carboxylic acids having a number average molecular weight of about 150 to about 1500, (ii) sulfur containing acids having a number average molecular weight of about 300 to about 1500, (iii) phosphorous containing acids containing hydrocarbyl substituents having one to about 50 carbon atoms, (iv) phenols having at least one hydrocarbyl substituent containing about 4 to about 400 carbon atoms;

provided that said metal salt has a conversion ratio from about 100 to about 3000;

(B) about 0.5 to about 3.0 weight-percent of at least one hydrocarbyl-substituted ashless dispersant wherein each hydrocarbyl substituent has a number average molecular weight up to about 1,500; and (C) a major amount of at least one oil of lubricating viscosity;

provided that said composition contains not more than 0.06 weight-percent calcium, not more than 0.5 weight-percent of hydrocarbyl-substituted ashless dispersant wherein the number average molecular weight of a hydrocarbyl substituent is greater than about 1,500, and not more than about 0.5 weight-percent olefin copolymer viscosity improver.

2. The composition of claim 1 wherein said composition contains not more than 0.06 weight-percent sodium.

3. The composition of claim 1 wherein said composition contains no more than 0.5 weight-percent polymeric viscosity improver.

4. The composition of claim 1 wherein said acidic organic compound of (A) comprises at least one carboxylic acid, sulfur-containing acid, phosphorus-containing acid, phenol or mixture of two or more thereof.

5. The composition of claim 1 wherein said acidic organic compound of (A) comprises at least one compound represented by the formula

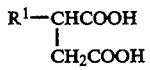

(IA)

or

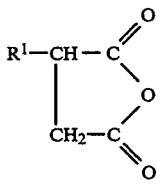

(IB)

wherein in Formulae I(A) and I(B), $R^1$ is a hydrocarbyl group of at least 8 carbon atoms.

6. The composition of claim 1 wherein said acidic organic compound of (A) comprises at least one compound represented by the formula

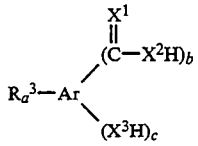

(II)

wherein in Formula III, $R^3$ is an aliphatic hydrocarbyl group; Ar is an aromatic group; $X^1$, $X^2$ and $X^3$ are independently oxygen or sulfur; a is a number in the range of zero to about 4; b is a number in the range of 1 to about 4; and c is a number in the range of 0 to about 4; with the proviso that the sum of a, b and c does not exceed the number of displaceable hydrogens on the aromatic nucleus or nuclei of Ar.

7. The composition of claim 1 wherein said acidic organic compound of (A) is a sulfonic acid.

8. The composition of claim 1 wherein said acidic organic compound of (A) comprises at least one compound represented by the formula $$R^4_e—T_d—(SO_3)_f \quad \text{(IV)}$$

wherein in Formula IV, $R^4$ is an aliphatic hydrocarbyl group, T is a cyclic hydrocarbyl group, d is 0 or 1, e is at least 1, and f is at least 1.

9. The composition of claim 1 wherein the metal salt of (A) comprises a metal salt of a hydrocarbyl-substituted carboxylic acid having a conversion ratio in the range from about 100 to about 2,000.

10. The composition of claim 1 wherein the metal salt of (A) comprises a metal salt of a hydrocarbyl-substituted carboxylic acid having a conversion ratio in the range from about 100 to about 1,000.

11. The composition of claim 1 wherein the metal salt of (A) comprises a metal salt of a sulfonic acid having a conversion ratio in the range from about 100 to about 1,500.

12. The composition of claim 11 wherein the metal salt of (A) comprises a metal salt of a sulfonic acid having a number average molecular weight in the range from about 300 to about 600.

13. The composition of claim 1 wherein said ashless dispersant (B) comprises at least one ester (B-1) derived from (B-1-a) a hydrocarbyl-substituted mono- or polycarboxylic acid or anhydride wherein each hydrocarbyl substituent has a number average molecular weight up to about 1,500 and (B-1-b) a polyhydric alcohol, or at least one such ester (B-1) post-treated with at least one amine.

14. The composition of claim 13 wherein (B-1) contains at least one unesterified hydroxyl group.

15. The composition of claim 14 wherein (B-1) is derived from a polyhydric alcohol containing at least about 3 hydroxyl groups.

16. The composition of claim 14 wherein (B-1) is derived from pentaerythritol.

17. The composition of claim 13 wherein (B-1) is a mono-oleate of sorbitol, mono-oleate of glycerol, mono-stearate of glycerol, di-stearate of sorbitol, di-dodecanoate of erythritol, or a polyester of pentaerythritol with a polyolefin(number average molecular weight up to about 1,500)-substituted succinic acid or anhydride.

18. The composition of claim 1 wherein (B) comprises at least one ester post-treated with at least one amine.

19. The composition of claim 18 wherein said at least one amine of (B) is (1) at least one alkylene polyamine having the structural formula

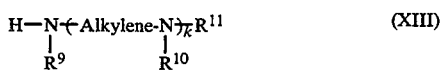

(XIII)

wherein in Formula (XIII), k is a number in the range from 1 to 10, $R^9$, $R^{10}$, and $R^{11}$ are independently a hydrogen atom, a hydrocarbyl group, a hydroxy-substituted hydrocarbyl group having up to 30 atoms, and the "Alkylene" group has from about 1 to about 10 carbon atoms, (2) at least one condensation product of two or more of said alkylene polyamines of Formula (XIII) or (3) a mixture thereof.

20. The composition of claim 18 wherein said at least one amine of (B) is at least one hydroxyalkyl-substituted alkylene polyamine having at least one hydroxyalkyl substituent bonded to a nitrogen atom, at least one condensation product of two or more of said hydroxyalkyl-substituted alkylene polyamines, or mixtures thereof.

21. The composition of claim 1 wherein said dispersant (B) comprises at least one acylated amine, or derivative thereof obtained by post-treating said acylated amine.

22. The composition of claim 21 wherein the at least one acylated amine is derived from a carboxylic acylating agent, or an ester thereof, and a polyamine which is a reaction product of an hydroxy-containing compound represented by the formula

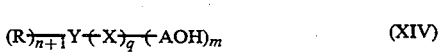

(XIV)

wherein R represents hydrogen or a hydrocarbyl group, Y represents nitrogen, oxygen or sulfur, X represents an alkylene group, A represents a hydrocarbylene group, m represents a number in the range from 1 to 3, q represents a number having a value of 0 or 1, and n represents a number having a value which, when added to the number 1, satisfies the valence of Y and a polyamine reactant represented by Formula (XV):

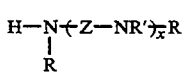

(XV)

wherein R is defined in the same was as defined above in Formula (XIV), R′ represents a hydrogen atom, an alkyl group or $NH_2R''(NR'')_y$ wherein y represents a number in the range from 1 to about 6 and R″ represents an alkylene group having from 1 to about 10 carbon atoms, Z represents an alkylene group having from 1 to about 10 carbon atoms, an oxyalkylene group having from 1 to about 10 carbon atoms, or a nitrogen-containing heterocyclic ring having from 1 to about 10 carbon atoms and x represents a number in the range from 1 to about 10.

23. The composition of claim 22 wherein in Formula (XIV) Y represents a nitrogen atom, m represents 2 or 3, n represents 1 and q represents 1.

24. The composition of claim 22 wherein the at least one acylated amine is derived from a polyamine comprising units represented by the formula:

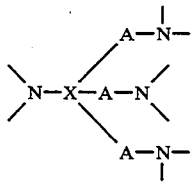

(XVI)

wherein X and A are the same as defined in Formula (XIV).

25. The composition of claim 22 wherein the hydroxy-containing compound of Formula (XIV) comprises tris(hydroxymethyl)aminomethane.

26. The composition of claim 25 wherein the polyamine reactant comprises triethylenetetramine, tetraethylene pentamine, or pentaethylene hexamine.

27. The composition of claim 25 wherein the polyamine reactant comprises amine bottoms.

28. The composition of claim 25 wherein the acylating agent comprises a hydrocarbyl-substituted succinic acylating agent in which each hydrocarbyl substituent has a number average molecular weight up to about 1,100.

29. The composition according to claim 28 wherein the at least one acylated amine exhibits a total base number in the range from about 55 to about 85 and the composition contains substantially no free amine.

30. The composition of claim 1 further comprising (D) up to about 1 weight-percent of at least one hydrocarbyl-substituted carboxylic acid or anhydride, a partial ester of a hydrocarbyl-substituted polycarboxylic acid or anhydride wherein an average of up to about 70 percent of the carboxyl groups of the acid or anhydride are esterified, or a metal or amine salt of said acid, anhydride or partial ester, other than the metal salt of (A) or the ashless dispersant of (B) in which each hydrocarbyl substituent has a number average molecular weight up to about 1,500.

31. The composition of claim 30 wherein (D) comprises at least one compound represented by the formula

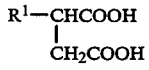

(IA)

or

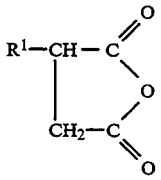

(IB)

or an amine salt thereof, wherein in Formulae IA and IB, $R^1$ is a hydrocarbyl group.

32. The composition of claim 30 wherein (D) comprises a polyisobutylene succinic acid or anhydride, or an amine salt thereof, wherein the polyisobutylene substituent has a number average molecular weight up to about 1,100.

33. The composition of claim 30 wherein (D) comprises the partial ester of a polycarboxylic acid or anhydride with an average of up to about 70% of the carboxyl groups of the acid or anhydride or esterified, or a metal or amine salt of said partial ester.

34. The composition of claim 30 further comprising (E) up to about 0.3 weight percent of at least one surfactant.

35. The composition of claim 34 wherein component (E) has an average HLB value in the range from about 10 to about 20.

36. The composition of claim 34 wherein component (E) is substantially non-ionic.

37. The composition of claim 34 wherein component (E) is an alkylene oxide-treated phenol, alcohol, ester, amine or amide.

38. The composition of claim 1 wherein the at least one oil (C) is a synthetic oil of lubricating viscosity.

39. A method of lubricating a sump-lubricated fuel-injected internal combustion engine comprising circulating the composition of claim 1 within said engine during operation of said engine.

40. The method of claim 39 wherein said circulating is conducted during operation of said engine with a fuel comprising a major amount of methanol or ethanol.

41. The method of claim 39 wherein said engine is a diesel engine.

42. The method of claim 40 wherein said engine is a diesel engine.

43. A composition comprising:

(A) about 0.05 to about 0.25 weight-percent of magnesium, said magnesium being present as at least one metal salt of at least one organic acid selected from the group consisting of:

(i) carboxylic acids having a number average molecular weight of about 150 to about 1500, (ii) sulfur containing acids having a number average molecular weight of about 300 to about 1500, (iii) phosphorous containing acids containing hydrocarbyl substituents having one to about 50 carbon atoms, (iv) phenols having at least one hydrocarbyl substituent containing about 4 to about 400 carbon atoms;

provided that said metal salt has a conversion ratio from about 110 to about 1000;

(B) about 0.5 to about 3 weight-percent of at least one ester (B-1) derived from (B-1-a) a hydrocarbyl-substituted mono-or polycarboxylic acid or anhydride wherein each hydrocarbyl substituent has a number average molecular weight up to about 1,500, and (B-1-b) a polyhydric alcohol having from 3 to about 10 carbon atoms and at least 3 hydroxyl groups, wherein said ester (B-1) contains at least one unesterified hydroxyl group, or at least one such ester post-treated with at least one amine; and (C) a major amount of at least one oil of lubricating viscosity;

provided that said composition contains not more than 0.06 weight-percent calcium, not more than about 0.5 weight-percent of hydrocarbyl-substituted ashless dispersants in which a hydrocarbyl substituent has a number average molecular weight greater than about 1,500, and not more than about 0.5 weight-percent of olefin polymer, olefin copolymer, styrene diene copolymer, and polymethacrylate viscosity improvers.

44. The composition of claim 43 wherein said composition contains not more than 0.06 weight percent sodium.

45. The composition of claim 43 wherein said composition contains not more than 0.5 weight-percent polymeric viscosity improver.

46. The composition of claim 43 wherein said acidic organic compound of (A) comprises at least one compound represented by the formula

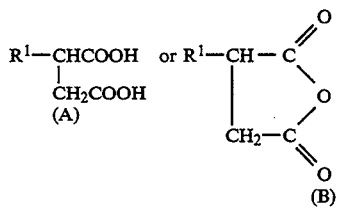

(I)

wherein in Formulae IA and IB, $R^1$ is a hydrocarbyl group.

47. The composition of claim 43 wherein said acidic organic compound of (A) comprises at least one compound represented by the formula $$R^4_e—T_d—(SO_3)_f \quad \text{(IV)}$$

wherein in Formula IV, $R^4$ is an aliphatic hydrocarbyl group, T is a cyclic hydrocarbyl group, d is 0 or 1, e is at least 1, and f is at least 1.

48. The composition of claim 43 wherein the at least one oil (C) comprises a synthetic lubricating oil.

49. The composition of claim 43 further comprising (D) up to about 1 weight-percent of at least one carboxylic acid or anhydride, a partial ester of a polycarboxylic acid or anhydride wherein an average of up to about 70 percent of the carboxyl groups of the acid or anhydride are esterified, or a metal or amine salt of said acid, anhydride or partial ester, other than a magnesium or barium salt of the carboxylic acid or anhydride.

50. The composition of claim 49 further comprising (E) up to about 0.3 weight-percent of at least one substantially non-ionic surfactant having an average HLB value in the range from about 10 to about 20.

51. A method for lubricating a sump-lubricated fuel-injected internal combustion engine comprising circulating the composition of claim 43 within said engine during operation of said engine.

52. The method of claim 51 wherein said circulating is conducted during operation of said engine with a fuel comprising a major amount of methanol or ethanol.

53. The method of claim 51 wherein said engine is a diesel engine.

54. The method of claim 52 wherein said engine is a diesel engine.

55. A composition comprising:

(A) about 0.05 to about 0.25 weight-percent of magnesium said magnesium being present as at least one metal salt of at least one organic acid selected from the group consisting of:

(i) carboxylic acids having a number average molecular weight of about 150 to about 1500, (ii) sulfur containing acids having a number average molecular weight of about 300 to about 1500, (iii) phosphorous containing acids containing hydrocarbyl substituents having one to about 50 carbon atoms, (iv) phenols having at least one hydrocarbyl substituent containing about 4 to about 400 carbon atoms;

provided that said metal salt has a conversion ratio from about 110 to about 1000;

(B) about 0.5 to about 3 weight-percent of at least one acylated amine, or derivative thereof obtained by post-treating said acylated amine; and (C) a major amount of at least one oil of lubricating viscosity;

provided that said composition contains not more than 0.06 weight-percent calcium, not more than about 0.5 weight-percent of hydrocarbyl-substituted ashless dispersants in which a hydrocarbyl substituent has a number average molecular weight greater than about 1,500, and not more than about 0.5 weight-percent of olefin copolymer, styrene diene, and polymethacrylate viscosity improvers.

56. The composition of claim 55 wherein said composition contains not more than 0.06 weight-percent sodium.

57. The composition of claim 55 wherein the at least one acylated amine is derived from a polyamine which is a reaction product of a hydroxy-containing compound represented by the formula $$(R)_{n+1}Y(X)_q(AOH)_m \qquad \text{(XIV)}$$

wherein R represents hydrogen or a hydrocarbyl group, Y represents nitrogen, oxygen, or sulfur, X represents an alkylene group, A represents a hydrocarbylene group, m represents a number in the range from 1 to 3, q represents a number having a value of 0 or 1, and n represents a number having a value which, when added to the number 1, satisfies the valence of Y and a polyamine reactant represented by Formula (XV):

$$H-\underset{\underset{R}{|}}{N}(Z-NR')_xR \qquad \text{(XV)}$$

wherein R is defined in the same way as defined above in Formula (XIV), R′ represents a hydrogen atom, an alkyl group, or $NH_2R''(NR'')_y$ wherein y represents a number in the range from 1 to about 6 and R″ represents an alkylene group having from 1 to about 10 carbon atoms, Z represents an alkylene group having from 1 to about 10 carbon atoms, an oxyalkylene group having from 1 to about 10 carbon atoms, or a nitrogen-containing heterocyclic ring having from 1 to about 10 carbon atoms and x represents a number in the range from 1 to about 10.

58. The composition of claim 57 wherein Formula (XIV) Y represents a nitrogen atom, m represents 3, n represents 1 and q represents 1.

59. The composition of claim 57 wherein the at least one acylated amine is derived from a polyamine comprising units represented by the formula:

(XVII)

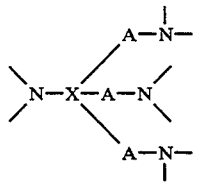

wherein X and A are the same as defined in Formula (XIV).

60. The composition of claim 57 wherein the polyamine reactant of Formula (XIV) comprises tris (hydroxymethyl) aminomethane.

61. The composition of claim 60 wherein the polyamine reactant comprises triethylenetetramine, tetraethylene pentamine, or pentaethylene hexamine.

62. The composition of claim 59 wherein the acylating agent comprises a hydrocarbyl-substituted succinic acylating agent in which a hydrocarbyl substituent has a number average molecular weight in the range from about 250 to about 1,100.

63. The composition of claim 62 wherein the at least one acylated amine exhibits a total base number in the range from about 55 to about 85 and the composition contains substantially no free amine.

64. The composition of claim 55 wherein the at least one oil (C) comprises a synthetic oil of lubricating viscosity.

65. A method for lubricating an alcohol-powered sump-lubricated fuel-injected internal combustion engine comprising circulating the composition of claim 55 within said engine during operation of said engine.

66. The method of claim 65 wherein said circulating is conducted during operation of said engine with a fuel comprising a major amount of methanol or ethanol.

67. The method of claim 65 wherein said engine is a diesel engine.

68. The method of claim 66 wherein said engine is a diesel engine.

69. A concentrate comprising:

(A) about 0.7 to about 3.6 weight-percent of magnesium, present as at least one magnesium salt of at least one organic acid selected from the group consisting of:

(i) carboxylic acids having a number average molecular weight of about 150 to about 1500, (ii) sulfur containing acids having a number average molecular weight of about 300 to about 1500, (iii) phosphorous containing acids containing hydrocarbyl substituents having one to about 50 carbon atoms, (iv) phenols having at least one hydrocarbyl substituent containing about 4 to about 400 carbon atoms;

provided that said metal salt has a conversion ratio from about 110 to about 1000;

(B) about 0.5 to about 3.0 weight-percent of at least one hydrocarbyl-substituted ashless dispersant wherein each hydrocarbyl substituent has a number average molecular weight up to about 1500; and (C) a major amount of at least one oil of lubricating viscosity;

provided that said composition contains not more than 0.06 weight-percent calcium, not more than about 0.5 weight-percent of hydrocarbyl-substituted ashless dispersant wherein the number average molecular weight of a hydrocarbyl substituent is greater than about 1500, and not more than 0.5 weight-percent olefin copolymer viscosity improver.

70. The concentrate of claim 69 wherein said concentrate contains not more than about 0.9 weight-percent sodium.

71. The concentrate of claim 69 wherein said concentrate further comprises:

(D) about 3 to about 7 weight-percent of at least one hydrocarbyl-substituted carboxylic acid or anhydride, a partial ester of a hydrocarbyl-substituted polycarboxylic acid or anhydride wherein an average of up to about 70 percent of the carboxyl groups of the acid or anhydride are esterified, or a metal or amine salt of said acid, anhydride or partial ester, other than the metal salt of (A) or the ashless dispersant of (B) in which each hydrocarbyl substituent has a number average molecular weight up to about 1,500 and (E) about 0.1 to about 8 weight-percent of at least one substantially nonionic surfactant having an HLB value in the range from about 10 to about 20.

72. A method of lubricating an alcohol-powered sump-lubricated fuel-injected internal combustion engine comprising circulating within said engine a lubricant composition comprising:

(A) about 0.05 to about 0.25 weight percent of magnesium present as at least one magnesium salt of at least one organic acid selected from the group consisting of:

(i) carboxylic acids having a number average molecular weight of about 150 to about 1500, (ii) sulfur containing acids having a number average molecular weight of about 300 to about 1500, (iii) phosphorous containing acids containing hydrocarbyl substituents having one to about 50 carbon atoms, (iv) phenols having at least one hydrocarbyl substituent containing about 4 to about 400 carbon atoms;

provided that said metal salt has a conversion ratio from about 100 to about 3000;

(B) about 0.5 to about 3.0 weight-percent of at least one hydrocarbyl-substituted ashless dispersant wherein each hydrocarbyl substituent has a number average molecular weight up to about 1,500; and (C) a major amount of at least one oil of lubricating viscosity;

provided that said composition contains not more than 0.06 weight-percent calcium and not more than 0.5 weight-percent of hydrocarbyl-substituted ashless dispersant wherein the number average molecular weight of a hydrocarbyl substituent is greater than 1,500, and not more than about 0.5 weight-percent olefin copolymer viscosity improver.

73. The method of claim 72 wherein said composition contains not more than 0.06 weight-percent sodium.

74. The method of claim 72 wherein said composition contains no more than 0.5 weight-percent polymeric viscosity improver.

75. The method of claim 72 wherein the lubricant composition further comprises:

(B) about 0.5 to about 3.0 weight-percent of at least one hydrocarbyl-substituted ashless dispersant wherein each hydrocarbyl substituent has a number average molecular weight up to about 1,500.

76. The method of claim 75 provided that the lubricant composition contains not more than 0.5 weight-percent polymeric viscosity improver.

77. The method of claim 72 wherein the at least one oil (C) comprises a synthetic oil.

78. The method of claim 76 wherein the at least one oil (C) comprises a major amount of a polyalphaolefin, dibasic acid ester or polyol ester synthetic oil.

* * * * *